US010870153B2

(12) United States Patent
Haidar

(10) Patent No.: US 10,870,153 B2
(45) Date of Patent: Dec. 22, 2020

(54) THERMOCHEMICAL PROCESSING OF EXOTHERMIC METALLIC SYSTEM

(71) Applicant: KINALTEK PTY. LTD., Bexley (AU)

(72) Inventor: Jawad Haidar, Bexley (AU)

(73) Assignee: KINALTEK PTY. LTD., Bexley (AU)

( * ) Notice: Subject to any disclaimer, the term of this patent is extended or adjusted under 35 U.S.C. 154(b) by 0 days.

(21) Appl. No.: 16/315,601

(22) PCT Filed: Jul. 6, 2017

(86) PCT No.: PCT/AU2017/050701

§ 371 (c)(1),
(2) Date: Jan. 4, 2019

(87) PCT Pub. No.: WO2018/006133

PCT Pub. Date: Jan. 11, 2018

(65) Prior Publication Data

US 2019/0201983 A1 Jul. 4, 2019

(30) Foreign Application Priority Data

Jul. 6, 2016 (AU) ..... 2016902659
Mar. 13, 2017 (AU) ..... 2017900864

(51) Int. Cl.
*B22F 9/20* (2006.01)
*C22B 5/04* (2006.01)

(52) U.S. Cl.
CPC ..... *B22F 9/20* (2013.01); *C22B 5/04* (2013.01); *B22F 2301/052* (2013.01)

(58) Field of Classification Search
None
See application file for complete search history.

(56) References Cited

U.S. PATENT DOCUMENTS 1,373,038 A 3/1921 Weber
2,745,735 A 4/1953 Byrns
(Continued)

FOREIGN PATENT DOCUMENTS

JP S57-43955 A 3/1982
SU 1759561 A1 9/1992
(Continued)

OTHER PUBLICATIONS

European Patent Office, English abstract for JP S57-43955 A, printed on Jan. 4, 2019.
(Continued)

*Primary Examiner* — George Wyszomierski
(74) *Attorney, Agent, or Firm* — Cahn & Samuels, LLP

(57) ABSTRACT

This invention relates to a method for controlling exothermic reactions between metal chlorides of Zn, V, Cr, Co, Sn, Ag, Ta, Ni, Fe, Nb Cu, Pt, W, Pd, and Mo, and Al and the use of the method for preparation of metallic alloys and compounds based on base metals Zn, V, Cr, Co, Sn, Ag, Ta, Ni, Fe, Nb Cu, Pt, W, Pd, and Mo. The method provides for a mixture of precursor chemicals including at least one solid base metal chloride to be mixed and reacted exothermically with a control powder based on Zn, V, Cr, Co, Sn, Ag, Ta, Ni, Fe, Nb Cu, Pt, W, Pd, and Mo and then reacting the resulting intermediates with an Al scavenger. Reduction is carried out in a controlled manner to regulate reaction rates and prevent excessive rise in the temperature of the reactants and the reaction products.

19 Claims, 17 Drawing Sheets

(56) References Cited

U.S. PATENT DOCUMENTS

Figure 1:
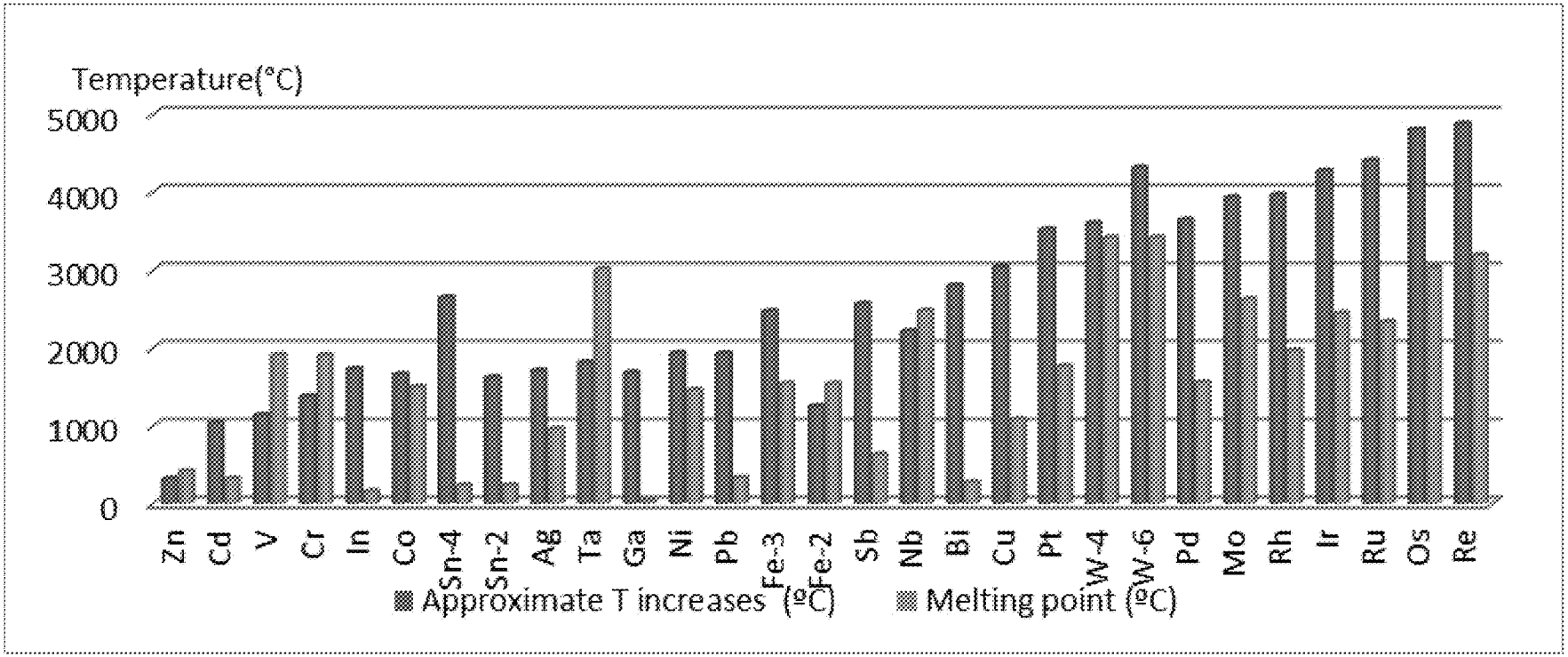

| | | | | |
|---|---|---|---|---|
| 2,791,499 | A | 5/1957 | Clegg et al. | |
| 2,986,462 | A | 5/1961 | Wright | |
| 3,010,787 | A | 11/1961 | Tornqvist | |
| 3,172,865 | A | 3/1965 | Fennell | |
| 3,252,823 | A | 5/1966 | Jacobson | |
| 3,288,596 | A | 11/1966 | Hoyt | |
| 3,801,307 | A | 4/1974 | Hurd | |
| 3,992,192 | A * | 11/1976 | Vartanian | B22F 9/20 75/344 |
| 4,060,462 | A | 11/1977 | Kampert | |
| 4,191,557 | A | 3/1980 | Kondis | |
| 4,687,632 | A | 8/1987 | Hurd | |
| 4,830,665 | A | 5/1989 | Winand | |
| 4,877,445 | A | 10/1989 | Okudaira et al. | |
| 4,902,341 | A | 2/1990 | Okudaira et al. | |
| 5,460,642 | A | 10/1995 | Leland | |
| 6,699,305 | B2 * | 3/2004 | Myrick | B22F 9/28 75/351 |
| 6,902,601 | B2 | 6/2005 | Nie et al. | |
| 6,955,703 | B2 | 10/2005 | Zhou et al. | |
| 7,435,282 | B2 | 10/2008 | Armstrong et al. | |
| 8,632,724 | B2 | 1/2014 | Haidar | |
| 8,821,612 | B2 | 9/2014 | Haidar | |
| 8,834,601 | B2 | 9/2014 | Haidar | |
| 2004/0050208 | A1 | 3/2004 | Nie et al. | |
| 2015/0275332 | A1 * | 10/2015 | Haidar | C22C 1/02 75/351 |
| 2016/0243622 | A1 | 8/2016 | Henderson et al. | |

FOREIGN PATENT DOCUMENTS

| | | | |
|---|---|---|---|
| WO | 2007/109847 | A1 | 10/2007 |
| WO | 2014/138813 | A1 | 9/2014 |

OTHER PUBLICATIONS

Australian Patent Office, International Preliminary Report on Patentability for PCT Application No. PCT/AU2017/050701, dated Jun. 15, 2018.

European Patent Office, Extended European Search Report for EP Application No. 17823347.4, dated Oct. 30, 2019, pp. 1-15.

Ding, J., et al., "Structure and magnetic properties of ultrafine Fe powders by mechanochemical processing," Journal of Magnetism and Magnetic Materials, vol. 162, Issues 2-3, Sep. 1996, pp. 271-276.

* cited by examiner

THERMOCHEMICAL PROCESSING OF EXOTHERMIC METALLIC SYSTEM

I. FIELD OF THE INVENTION

The present invention relates to a method for preparation of alloys and compounds based on one or more of Zn, V, Cr, Co, Sn, Ag, Al, Ta, Ni, Fe, Nb Cu, Pt, W, Pd, and Mo, and/or Pb, Sb, Bi, In, Cd, Ga, Rh, Ir, Ru, Os, Re.

II. BACKGROUND OF THE INVENTION

Metallic powders based on alloys and compounds of the transition metals can be used in a wide range of industrial applications. Metallic powders are often produced through a multi-step melting process involving melting ingots of the required alloy constituents followed by evaporation or atomisation. The melting route presents significant difficulties in manufacturing many compositions when those alloys include reactive additives. There is also the requirement for an accurate and uniform composition throughout the powder product, and this can be difficult to achieve when the constituting elements have widely differing physical properties.

Some pure metal powders are produced using the carbonyl route, wherein the metal constituents are converted into a gaseous carbonyl that is then heated under conditions appropriate for decomposition into the relevant metal and the product is usually in the form of a powder. This route is used on an industrial scale for production of several materials such as Ni, but is generally not suitable for most alloys.

There is need for a new technology to avoid problems associated with the current indirect melting route for production of alloys and to enable production of high quality powders at low cost. Equally, there is need for a new process that permits formation of compounds that cannot be obtained using current melt routes where the constituting elements are not chemically compatible.

The present disclosure aims to describe a method and an apparatus for producing transition metal, metal alloy or metal compound powders at a low cost.

III. SUMMARY OF THE INVENTION

Herein, unless the contrary intention appears:

The term "base metal" refers to any one or more of the elements Zn, V, Cr, Co, Sn, Ag, Ta, Ni, Fe, Nb Cu, Pt, W, Pd, Mo, Pb, Sb, Bi, In, Cd, Ga, Rh, Ir, Ru, Os, and Re.

The term "base metal alloys" refers to alloys or compounds based on the base metals and containing the base metals with a total concentration higher than 10 wt %, and particularly higher than 25 wt %, and more particularly higher than 50 wt %.

The term "alloying additives" refers to any one or more elements or compounds based on O, N, S, P, C, B, Si, Mn, Ti, Zr, and Hf. Metallic additives can exist with individual concentrations at levels preferably below 10 wt % and with a total concentration for all additives preferably less than 50 wt %. However, Al can exist in larger concentrations up to 90 wt %, and C, B and Si can exist in concentrations up to more than 25 wt %.

The term Al reducing agent refers to pure Al or an Al alloy, in a powder form, used to reduce the base metal halide reactant.

The terms "control powder" or "control agent" refer to powders added to the reactants to control or alter energetic/kinetic reaction behaviour of the reduction reaction. The control powder is a solid powder having a reactivity with the base metal halides or the Al reducing agent lower than the reactivity of the halides with the Al reducing agent. The "control powder" or "control agent" can be made of a pure metal or a metal-based compound, such as an alloy, an intermetallic, a halide (e.g. chloride), an oxide or a nitride.

The term "base metal halide(s)" refers to the starting base metal halide(s), for example chloride(s), and the term "base metal subhalide(s)" refers to halides with a lower valence than the starting halide(s).

The terms "$AlCl_3$", "aluminium chloride" and "aluminium chlorides" may refer to describe all Al—Cl compounds, including $AlCl_3$ and $Al_2Cl_6$ in both gas and solid phases. "Aluminium halide" has analogous meaning.

The term "in a fine particulate form" refers to powders with a mean particle size less than 500 microns and preferably less than 50 microns and more preferably less than 15 microns, in at least one dimension.

For the base metals to which the present invention relates, reduction of the base metal chlorides with Al is highly exothermic and may lead to a thermal runway with excessive increases in the temperature of the reactants. The present invention provides a method for controlling exothermic reactions between base metal chlorides and Al and uses the method for reducing solid metal chlorides based on Zn, V, Cr, Co, Sn, Ag, Ta, Ni, Fe, Nb Cu, Pt, W, Pd, and Mo to their base metals or alloys.

In one form, the process overcomes thermal runway effects due to the exothermic reactions by contacting the base metal halide powder with a control powder and contacting the mixture with the Al reducing agent. The inclusion of the control powder acts to moderate the rate of the exothermic reaction, add thermal mass, and optionally act as a reducing agent to partially reduce the base metal halide as an intermediate. In the following, we refer to base metal chlorides to illustrate the process and explain the various processing steps. However, use of other halides is within the scope of the invention and using the chloride example is not intended as limiting.

The reactions between base metal chlorides and Al may be divided into two steps, wherein the base metal chlorides are mixed and reacted with a control powder based on Zn, V, Cr, Co, Sn, Ag, Ta, Ni, Fe, Nb Cu, Pt, W, Pd, and Mo, and then the resulting intermediate product is reacted with an Al scavenger. The two reaction steps are carried out while providing a combination of control mechanisms, including:

providing the control powder to (i) react with the base metal chlorides, (ii) moderate the reaction rate, (iii) reduce the intensity of exothermic heat release and (iv) absorb heat generated by the reaction; and optionally providing external additional means for controlling the reaction rates through gradually mixing and reacting the solid reactants; and optionally providing external effective energy management to remove heat generated by the reactions.

The reduction process may be divided into two stages:

a reduction stage to carry out controlled reduction of the base metal chlorides with the control powder and the Al scavenger at temperatures less than 660° C. but mostly less than 500° C.; and a purification stage at temperatures above the sublimation/evaporation points of the chlorides to purify the powder product and induce agglomeration when required or needed.

The process can be operated in a full batch mode, in a semi-batch mode or in a full continuous mode.

The present invention comprises several aspects:

In a first aspect, there is provided a method for controlled exothermic reduction of a metal halide of one or more of Zn, V, Cr, Co, Sn, Ag, Ta, Ni, Fe, Nb Cu, Pt, W, Pd, Mo, Pb, Sb, Bi, In, Cd, Ga, Rh, Ir, Ru, Os, and Re, with an Al reducing agent, the method comprising:

contacting said one or more metal halides, a control powder and an Al reducing agent, all in a fine particulate form, at temperatures between 25° C. and a maximum temperature $T_{max}$ to form a metal or metal alloy product in a powder form and a by-product including aluminium chloride; and separating the by-products from the metal alloy powder product;

wherein the control powder includes one or more of Zn, V, Cr, Co, Sn, Ag, Ta, Ni, Fe, Nb Cu, Pt, W, Pd, and Mo, or an alloy or compound thereof, and acts to control exothermic heat release from the reduction reaction and to thereby keep reaction temperatures to less than $T_{max}$; and wherein $T_{max}$ is between 400° C. and 1100° C., and below the melting temperature of the base metal or metal alloy product.

The control powder can be a final, fully reduced product of the method, or an intermediate, partly reduced product of the method, or a powder different from the end-product but selected from one or more of the other base metals compatible with the required composition of the required end-product. In a preferred embodiment, the control powder may also include aluminium chlorides, and sublimation of the aluminium chloride acts as a coolant removing heat away from the reaction zone where exothermic chemical reactions are taking place.

In a second aspect, there is provided a two-stage method for producing inorganic powders based on Al, Zn, V, Cr, Co, Sn, Ag, Ta, Ni, Fe, Nb Cu, Pt, W, Pd, and Mo, and/or Pb, Sb, Bi, In, Cd, Ga, Rh, Ir, Ru, Os, Re, wherein:

In a first reduction stage (hereinafter referred to as the Reduction Stage), base metal chlorides, a control powder and an Al alloy powder are gradually introduced into a first reaction zone at temperatures between 25° C. and 700° C. and preferably between 160° C. and 660° C. and more preferably between 200° C. and 600° C., and the mixture is gradually reacted while controlling the reactant feed rate to maintain the reactants at a moderate temperature below 660° C. and preferably below 600° C.; the control powder can be the resulting base metal products. The feed rate, the mixing and the ratio of control powder to base metal chlorides are control mechanisms which may be used to limit temperature increases due to the exothermic energy release and maintain equilibrium between heat generated by the reactions and heat removal by external cooling. At the end of the Reduction Stage, there results formation of a solid base metal powder product which may include residual base metal chlorides and residual Al reducing agent.

In a second purification stage (hereinafter referred to as the Purification Stage), products from the Reduction Stage are transferred to a second reaction zone and heated to a temperature above the sublimation/evaporation temperatures of the base metal chlorides and preferably below the melting temperature of the base metal alloy products; the Purification Stage serves to purify the powder product and complete the reaction leading to formation of a solid powder product and gaseous by-products.

In a third aspect, there is provided a method for producing catalysts and structured materials, wherein the product is a metal, an alloy or a compound based on one or more the base metals Zn, V, Cr, Co, Sn, Ag, Al, Ta, Ni, Fe, Nb Cu, Pt, W, Pd, and Mo, and/or Pb, Sb, Bi, In, Cd, Ga, Rh, Ir, Ru, Os, Re, and further includes alloying additives. According to the method of this aspect, a base metal or base metal alloy is produced according to the methods of the first aspect or the second aspect, and the method can include the additional step of post processing the resulting base metal alloy powder to induce changes in its composition and/or in its morphology. Means for carrying out the additional step can include dissolving the Al in an alkaline solution or an acidic solution, and reacting the base metal powder with reactive elements such as oxygen, hydrogen, sodium and/or sulphur. The control powder can be a final or intermediate product of the method, or a powder different from the end-product and added with the starting chemicals.

In a fourth aspect, there is provided a method for production of multi-component alloy powders and composites wherein the control powder has a substantially different composition from the elemental composition produced through reduction of the starting base metal chlorides with Al and wherein the final product contains a substantial amount of unreacted control powder; the control powder can be in the form of a powder with a melting temperature higher than 660° C. The control powder forms one component of the product constituents.

Heat may be removed from the reactants to limit temperature increases due to exothermic energy release to a manageable level.

In a fifth aspect of the invention, there is provided a modular apparatus for production of a base metal or base metal alloy powders based on Al, Zn, V, Cr, Co, Sn, Ag, Ta, Ni, Fe, Nb Cu, Pt, W, Pd, and Mo, and/or Pb, Sb, Bi, In, Cd, Ga, Rh, Ir, Ru, Os, Re. The apparatus may comprise:

storage containers for holding solid reactants under inert atmosphere; and powder feeding accessories; and powder mixers; and a first reaction vessel capable of operating with metal powders and metal chlorides at temperatures up to 700° C.; the vessel includes means arranged for feeding, mixing, stirring and reacting separate materials stream comprising the reducible chemicals, the control powder and the Al reducing agent; the reaction vessel arranged in use for the reactants to be heated to a first temperature sufficient for the mixture of reducible chemicals, control powder and the aluminium to react leading to intermediate products based on the base metals; the vessel includes a section at lower temperature to cause condensation of chemicals from the reactor vessel and of aluminium chlorides if required. The first reaction vessel includes apparatus for moving the reactants in and out of the reaction vessel, together for recycling at least a part of the intermediate products for use as a control powder; and a second high temperature reaction vessel capable of being heated at temperatures up to 1100° C. and arranged in use for the reactants from the first reaction vessel to be heated to a second temperature sufficient for the intermediate powder product to further react and form a solid powder product based on the base metals;

a by-product collection vessel; and a product collection vessel.

Typically, the apparatus includes heating/cooling apparatus for controlling the temperature of the reactants within the limits of the required operation and product characteristics. Openings may be provided for the introduction of inert and reactive gases.

Preferably, the apparatus of the fifth aspect of the invention is suitable for implementing the method of any of the aspects of the invention described herein.

One form of the present invention provides a novel method for controlling exothermic reactions between base metal chlorides and Al and a process implementing the method for direct production of base metal or alloy powders starting from low-cost chemicals. The invention overcomes problems usually associated with the melting/atomising route such as segregation and enables production of alloys in qualities that may not be possible through the melt route. The present invention relates to base metals $M_b$, where all reactions between Al and any stable chloride species based on $M_b$ and Cl ($M_bCl_x$) leading to the base metal are exothermic at all processing temperatures between 250° C. and 1000° C. corresponding to the processing conditions of the required base metal alloys.

In a most preferred embodiment, the method provides procedures for reducing base metal chlorides of Zn, V, Cr, Co, Sn, Ag, Ta, Ni, Fe, Nb Cu, Pt, W, Pd, and Mo to produce base metal or alloys. The method uses Al as a chlorine scavenger and provides safe and effective means for overcoming difficulties due to the extreme reactivity between Al and the reducible base metal chlorides. The method allows for including additives based on the alloying elements and Al. Embodiments discussed in the following sections describe procedures and rules for implementing the method and for controlling thermal effects due to energy released by the reduction reactions.

The method of the present invention can be operated in batch mode, semi-continuous mode or in continuous mode by exothermically reacting solid base metal chlorides with a control powder and reducing compounds comprising Al. Preferably, the reacting step is carried out through reacting the base metal chlorides with the control powder first and then reacting the resulting mixture with Al. The method provides for separate streams of reducible base metal chlorides and an Al reducing agent to be fed continuously into a reaction zone containing a control powder in a scheme designed to achieve effective management for the heat generated by exothermic reduction between of the reactants.

In one preferred embodiment, the method comprises the steps of mixing and reacting a first stream of reducible precursor chemicals comprising at least one reducible solid base metal chloride, a second stream comprising a control powder and a third stream comprising a Al reducing agent in a fine solid particulate form, at temperatures between $T_0$ and $T_{max}$ to form a product in a powder form and a by-product including gaseous aluminium chloride; To is preferably below the melting point of the Al reducing agent and $T_{max}$ is between 400° C. and 1100° C.; reactions between the reducible chloride(s) and the Al reducing agent are exothermic and the method includes means for controlling the reaction rate and limiting the temperature of the reactants to less than the 1100° C. and more preferably to less than 1000° C. and still more preferably to less than 900° C. The reducible mixture may comprise precursor chemicals for alloying additives including metallic, semi-metallic or non-metallic elements from the periodic table.

$T_{max}$ depends on the physical characteristics of the base metal products and is generally limited by its melting temperature. $T_{max}$ is between 400° C. and 1100° C. and is preferably higher than the sublimation/evaporation temperatures of the starting base metal chlorides but preferably lower than the melting temperature of the base metal or alloy product.

In one embodiment, $T_{max}$ is below 1100° C. In a second embodiment, $T_{max}$ is below 1000° C. In a third embodiment, $T_{max}$ is below 900° C. In a fourth embodiment, $T_{max}$ is below 800° C. In a fifth embodiment, $T_{max}$ is below 700° C. In a sixth embodiment, $T_{max}$ is below 600° C.

The starting amount of the Al reducing agent depends on the amount of the starting reducible chemicals and the required concentration of Al in the end products. Preferably, the amount of Al in the starting materials relative to the reducible chemicals corresponds to a value between 80% and 5000% of the amount required to reduce all the reducible precursor chemicals to their elemental base metal state. The amount of Al in the base metal alloy product ranges from 0.0001 weight (wt) % to 90 wt %.

The choice of the control powder depends on the required characteristics of the alloy powder products. For common alloys and compounds, the control powder can be a pre-processed product or a semi-processed product of the reaction that is preferably mixed and reacted with the starting solid reducible precursors prior to reacting with the Al alloy. Also, the control powder can be one constituent of the required base metal or alloy product.

Preferably, base metal species in the control powder have a Cl content less than 50% and preferably less than 75% of the starting reactants. For production of composite products or multi-component products, the control powder can be one of the product constituents and may be different from the base metal species being processed.

The relative amount of the starting solid base metal chlorides to the control powder depends on a combination of factors, including the Gibbs free energy of the reaction between the base metal chloride and the Al, and thermal properties of the reactants and the control powder, and typically ranges from 0.03:1 to 50:1 or 100:1 by weight; for some highly exothermic reactions the ratio can be 1 part chlorides to 35 parts control powder by weight.

The present approach allows for low-cost production of a wide range of existing common alloys and compositions in addition to other compositions that may not otherwise have been possible to produce in commercial quantities. An advantage for the present approach in its preferred forms over prior relevant arts is in the ability to achieve effective control over reaction mechanisms and to maximise reaction yield for reducing the starting precursor materials.

Features of preferred forms of the present approach include:

1—Exothermic reduction reactions between the reducible base metal chlorides and Al are carried out safely under controlled conditions.

2—The control powder may act as an intermediate reducing agent, enabling control over reaction kinetics. This is particularly important for multi-component systems and for multi-valence base metal chlorides, where reactions between base metal chlorides and the control powder play a major role in moderating exothermic energy release.

3—Reduction of the base metal chlorides is mostly carried out in the Reduction Stage at temperatures below 600° C. and mostly below 500° C. In aspects of the methods of the present invention, at least 50% and preferably at least 60% and more preferably at least 75% of the chlorine in the starting base metal chlorides are removed in the Reduction Stage.

4—The method is not dependent on producing intermediate compounds and for most base metals, the reduction reactions lead directly to elemental species.

5—The control powder acts as a heat sink and it moderates reaction rates between the starting chemicals, hence reducing the intensity of exothermic energy generation.

6—Most reactions between the reducible chlorides and the reducing Al occur at temperatures below 500° C. where formation of aluminides is not favourable and is slow, thus allowing the reducing Al to remain active for further reactions.

7—The hot by-product gas produced by the reactions causes significant mixing of the reactants and helps regenerate contact surface between and increase reaction yield. This helps overcome limitations on solid-solid reactions usually resulting from diffusion controlled kinetics when reaction products form layers around the reactants.

8—Exothermic reactions can include reactions involving reacting alloying additives or alloying additive precursors with other base metal species or Al, and such exothermic reactions can be managed through procedures and embodiments described herein as a part of the method.

9—The method will be illustrated in the following discussion using examples based on simple stoichiometric reduction reactions with pure aluminium leading to the base metal(s).

The overall reaction between base metal chlorides and Al is:

$$M_bCl_x+x/3Al=M_b+x/3AlCl_3(g)+\Delta G,\ \Delta G<0 \quad (R1)$$

$M_b$ is the base metals and $M_b$ $Cl_x$ the corresponding reducible base metal chlorides, $AlCl_3(g)$ is gaseous aluminium chloride and ΔG is the Gibbs free energy for reaction (R1). $M_b$ can be in the form of a pure element such as Ta, a solid solution such as Ni—Cu, a compound such as $Ni_3Al$ or a multi-component system such as metal matrix composites.

The ability of Al to reduce metal chlorides (and halides and oxides more generally) is well known and aluminothermic reduction of oxides and halides has been known for more than 100 years. Al is known to be a universal reactant and its ability to reduce metal halides is usually cited as an example for single replacement reactions commonly found in undergraduate text books and in basic chemistry essays, (e.g. see "Aluminium Alloys—New Trends in Fabrication and Applications", Ed. Z Ahmad, InTech, 2012, DOI: 10.5772/52026; and Jena and Brocchi in *Min. Proc. Ext. Met. Review* vol 16, pp 211-37 1996). Examples for early attempts for production of metallic alloys through reduction of wide range of metal chlorides with Al can be found in U.S. Pat. Nos. 3,252,823 and 5,460,642. Other relevant literature involving Al can also be found in many early disclosures relating to reduction of metal chlorides and production of metal alloys (e.g. U.S. Pat. Nos. 1,373,038, 2,791,499 and 2,986,462 and 3,801,307, 4,604,62 and 4,191, 557).

Aluminothermic reduction of transition metal compounds has been an active area of R&D since early last century. The main difficulties for aluminothermic reduction of transition metal chlorides are due to two factors; (i) the tendency of Al to alloy readily with other metals and (ii) the exothermic reactions between most transition metal chlorides and Al which often lead to uncontrollable processing with formation of arbitrary aluminide phases. Resolving these difficulties depends on the individual chemistry on the metals and from the perspective of aluminothermic reduction of metal chlorides, transition metals can be classified into three categories:

Category 1: Systems where reactions between the metal chlorides and Al are not exothermic (i.e. Sc, Y and Hf). For this category, aluminothermic reduction of metal chlorides can proceed only through shifting equilibrium to the right as has been disclosed for Sc in WO2014138813, where the reaction was carried out under reduced pressures to drive the reaction out of equilibrium and towards producing metallic Sc-compounds. For this category, the end-products are usually metal aluminides.

Category 2: Systems where the chlorides are multi-valent and the reactions are only partially exothermic, and where the problem is mostly due to excessive affinity between the metal and Al; i.e. Ti, Zr and Mn. For this category, the chemistry of the systems Ti—Cl—Al, the Zr—Cl—Al and the Mn—Cl—Al are different from all other transition metals because reactions leading to the metal are only partially exothermic while reactions leading to aluminides are exothermic.

For Mn and Zr, the Al reduction route has not been of great interest in the literature. In contrast, there have been extensive attempts to produce Ti and Ti alloys through aluminothermic reduction of titanium chlorides. For Ti, reactions of $TiCl_4$ with Al leading to $TiCl_2$ and $TiCl_3$ are exothermic but further reactions of titanium subchlorides with Al are endothermic at less than 550° C. However, all reactions between $TiCl_x$ and Al leading to the aluminides are exothermic and the affinity between Ti and Al is such that formation of aluminides is thermodynamically more favourable than reduction of titanium subchlorides. The combination of exothermic energy release for $TiCl_4 \rightarrow TiCl_3$ and the affinity of Ti—Al meant that reducing $TiCl_4$ directly to Ti-based metallic species results in products with uncontrollable composition and phases. To separate the exothermicity problem from the Ti—Al affinity problem, there have been various disclosures (e.g. U.S. Pat. Nos. 2,745,735, 8,562,712, 8,632,724, 8,821,612 and 8,834,601) where the reaction is divided into two stages; in a first stage, $TiCl_4$ is reduced to $TiCl_{(2,3)}$ and then in a second stage, the resulting $TiCl_{(2,3)}$ are reacted endothermically with Al to produce Ti. This approach reduces the overall problem to the affinity between Ti and Al as there exist several effective methods for carrying out the first half of the reaction from $TiCl_4$ to subchlorides (e.g. U.S. Pat. Nos. 3,010,787, 3,172,865 and references therein).

For most disclosures on production of Ti and Ti alloys through the Al reduction route, reaction conditions were arranged to alter the equilibrium to control/minimise formation of titanium aluminides.

Generally, aluminothermic processes for production of metals and alloys in Categories 1 and 2 are inadequate for other metal systems involving exothermic reactions.

Category 3: This third category includes the rest of the transition metals where all reactions between the chlorides and Al are exothermic; here, reactions between metal chlorides with Al usually lead to formation of uncontrollable phases due to loss of control over the reaction kinetics resulting from exothermic heat release.

For this third category consisting of Zn, V, Cr, Co, Sn, Ag, Ta, Ni, Fe, Nb, Cu, Pt, W, Pd, Mo, Rh, Ir, Ru, Os, Pb, Sb, Bi, Cd, Ga and Re, formation of aluminides due to melting of Al particulates by exothermic thermal effects dominates over normal alloying activities leading to aluminides. The inventor finds that retention of Al in the end-products can be minimised if thermal effects associated with exothermic energy release are avoided. Exothermic reactions between chlorides of transition metals in Category 3 and Al can generate excessive heat together with emanation of significant quantities of gaseous by-products, and thus they can be hazardous. For example, the reaction $FeCl_3+Al \rightarrow Fe+AlCl_3$ with a $\Delta G=-264$ kJ/mole (at 200° C.) is very rapid and can increase the temperature of the resulting products to more than 2000° C., making this reduction route unsuitable for producing Fe-based alloy powders with adequate material properties at a viable production cost. It is difficult to control such reactions and it is a main objective of the present invention to describe procedures for carrying out the reduction reactions effectively leading to formation of high quality alloy powders in a controllable and safe manner. It is another main objective for the present invention to provide a method for controlling replacement reactions between base metal chlorides and Al on a highly localised level, whereby increases of temperature throughout the reactants is avoided and/or minimised.

The present disclosure deals with this third category and provides a method for controlling reactions between Al and the chlorides of transition metals including Zn, V, Cr, Co, Sn, Ag, Ta, Ni, Fe, Nb Cu, Pt, W, Pd, Mo, Rh, Ir, Ru and Os, and/or Pb, Sb, Bi, In, Cd, Ga, Rh, Ir, Ru, Os, Re, allowing for production of high-quality powders of alloys and compounds based on the metals in this category. To our knowledge, there has not been any prior art for producing alloy powders of the sort described here.

The present invention relates to base metals $M_b$, where all reactions between Al and stable chloride species based on $M_b$ and Cl ($M_bCl_{1-n}$) leading to the elemental base metal are exothermic at all processing temperatures between 25° C. and 1000° C. corresponding to the processing conditions of the required base metal alloy—as per the any of following embodiments; $MbCl_{1-n}$ represent all stable chloride species that can form during processing. Hereinafter, this condition is referred to as the exothermicity criterion, and as defined within the context of the present disclosure, only base metals fulfilling this criterion are included. The inventor finds that the use of materials that do not meet the exothermicity criterion promotes retention of excessive amounts of Al in the end products and tends to favour formation of base metal aluminides. Also, metals that do not meet the exothermicity criterion tend to act as a reducing agent for the base metal chlorides, resulting in high levels of unreacted chlorides remaining in the end products. For example, when zirconium is used, the end-product would contain high levels of Al together with residual zirconium chlorides/subchlorides.

For prior attempts to reduce mixtures of halides (e.g. chlorides) for direct production of alloyed products, the approach has been popular and there have been multiple disclosures in both the open literature and the patent literature. Examples can be found in the literature; e.g. DeKock and Huffman, Met. Trans. B, volume 18B (1987) 511; Cost affordable titanium IV, Imam, Froes and Dring, Trans Tech Publications 2010; and U.S. Pat. Nos. 4,902,341, 4,830,665, 6,955,703, 4,687,632, 6,699,305, 7,435,282 and 6,902,601. A more recent example is in US patent application US20160243622 disclosing a process for production of metal powders through reduction of metal halides with reducing elements including Al. In this disclosure, halides of a wide range of transition metals are reduced in an agitated bath of the reducing agent metal (e.g. Al) and then the resulting powders are separated from the by-product salt in a second stage.

It is not the object of the present disclosure to claim reduction for mixtures of reducible compounds, but it is an objective for the disclosure to provide a novel way by which a mixture of reducible chlorides can be safely and effectively reduced with Al leading to useful products with controllable characteristics.

In Nie et al. in U.S. Pat. No. 6,902,601, Al was also used for reducing metal chlorides to produce metals and alloys starting from metal chlorides. Nie et al. employed $H_2$ as an intermediary to avoid contact between metal-based species (metal chlorides and metals) and Al, hence avoiding formation of uncontrollable aluminide phases, usually caused by the exothermic heat release. However, the use of $H_2$ in U.S. Pat. No. 6,902,601 has limitations relating to various aspects including safety and quality of materials due to possible formation of hydrides and diffusion of $H_2$ into the powder grains. The present invention provides significant improvements over the approach in U.S. Pat. No. 6,902,601 in that it solves problems associated with the energetics of the process and extends the range of base metals that can be used while not degrading the quality of products through inclusion of impurities.

The inventor has established that addition of a control powder to the base metal reactants and Al provides adequate control over the reaction kinetics and enables reduction of base metal chlorides with aluminium safely and under controlled conditions. The inventor found that the control powder moderates the effects of the exothermic energy release in several different ways:

(i) The control powder allows reaction (R1) to be divided into two parts:

$$M_bCl_x+nM_c=M_pCl_x+\Delta G_1,\ \Delta G_1\leq 0 \quad \text{(R2)}$$

$$M_pCl_x+x/3Al=M_p+x/3AlCl_3(g)+\Delta G_2,\ \Delta G_2<0 \quad \text{(R3)}$$

With $\Delta G=\Delta G_1+\Delta G_2$ $M_c$ represents the control powder, $\Delta G_1$ and $\Delta G_2$ are the Gibbs free energy for reactions R2 and R3 respectively. $M_p$ represents the average product composition of the combination $M_b$-$M_c$ with a total mass equivalent to $M_b+nM_c$, where n is the ratio of $M_c$ to $M_bCl_x$ in the starting precursors. $M_pCl_x$ represents the average composition of the mixture Mc-Mp-Cl resulting from reaction (R2). $M_p$ can be in the form of a pure element such as Ta, a solid solution such as Ni—Cu, a compound such as $Ni_3Al$ or a multi-component system such as metal matrix composites. Extending this scheme into more complex systems for synthesis of complex alloys will become evident in the following discussion.

Intermediate reactions between the reducible base metal chlorides and the control powder allow for improved thermal management of the process and help conduct chlorine throughout the reactant mixture, and therefore enhance the reaction efficiency.

Reactions involving the control powder include reactions with the reducible base metal chlorides $M_bCl_x$, reactions with the base metals $M_b$, reactions with Al and reactions with the Al chloride by-products.

For embodiments where the control powder is based on a single element and has the same composition as the base metal alloy, reactions between $M_c$ and $M_bCl_x$ would be limited to chlorine exchange reactions. Although this type of reaction does not involve significant energy transfer, it helps transport chlorine and contribute to the overall reaction yield. In such cases, the control powder role is mostly through control of reaction rates for reactions between $M_bCl_x$ and Al.

For embodiments where $M_c$ is different from $M_b$, reactions between $M_c$ and $M_bCl_x$ become a key factor in the reaction path and the overall reaction kinetics. Then, the control powder plays a full role as a reducing agent, heat sink and reaction rate moderator. For example, for an alloy containing Ni and Cr produced through reduction of $NiCl_2$ and $CrCl_3$ with Al in the presence of a Ni—Cr control powder, $NiCl_2$ in the starting precursor chemicals can react with Cr in the control powder to produce chromium chloride that is then reacted with Al to complete the reduction reaction.

In another example for production of pure Ta, $TaCl_5$ in the starting chemicals reacts with Ta in the control powder to produce tantalum subchlorides ($TaCl_{2-4}$), which are subsequently reacted with Al to complete the reduction reaction. As such, the intensity of exothermic energy generation reduces, allowing for enhanced control over the reduction process.

For reactions between $M_c$ and Al, although they can lead to formation of aluminides it is likely that they are of secondary importance as all reduction reactions are carried out at low temperatures below 600° C. where formation of aluminides is not favourable. Also, for most of the base metals subject to the present disclosure, reduction of base metal chlorides with aluminides leading to the base metals are generally favourable. Other reactions of importance involving $M_c$ are back reactions involving aluminium chlorides and leading to formation of $M_cCl_y$ which shift/balance the reaction towards the left and hence reduce intensity of the forward exothermic reduction reactions.

The inventor found that the control powder acts as an inertial thermal absorber helping overcome problems associated with the exothermic reactions discussed above; for example, for reaction R1, mixing the starting chloride powder $M_bCl_x$ with a pre-processed powder of the base metal $M_b$ before reacting with the Al reducing agent helps control the thermal runaway effect and all its associated problems. The control powder acts to reduce the energy density per unit of mass and thus limits temperature increases due to exothermic heat as the exothermic energy generated by the reaction is distributed over a larger load consisting of the reaction products.

The materials streams of the reactants are fed separately and contacted only inside the reaction zone. The rate of the mixing of the three streams is an additional control mechanism determining the reaction rate.

Other mechanisms that help reduce the intensity of exothermic energy release and enable more effective external cooling for the reactants include:

a. reduction in the reaction rate due to reduced direct contact surface area between the $MbCl_x$ and Al; and b. shifting the equilibrium to the left due to back reactions between $M_b$ and $AlCl_3$. For the method of the present invention, equilibrium conditions are favoured and in the Reduction Stage, the reactants, including aluminium chlorides are preferably kept in (or returned to) the reaction zone to optimise equilibrium conditions and drive the reaction towards obtaining equilibrium products. For all base metals considered here, the reactions are highly favourable and actively driving the reaction out of equilibrium can hamper the outcome of the process and increases the rate of exothermic heat generation.

The control powder acts to contain exothermic reactions with the Al reducing agent and convert momentum from the reaction into efficient mixing of the reactants, thus allowing for enhanced reaction yield. For most base metal chlorides subject to the present disclosure, the amount of control powder is several times the amount of the reducible chemicals. Because the reducible reactants become localised within micro-cavities of control powder, there results a more effective way for absorbing the energy released by the reaction. Also, hot by-product gas generated by the reaction can significantly enhance mixing the reacting materials.

Preferably, the control powder is made of final or intermediate reaction products based on the base metals. Preferably, the pre-processed powders or alloys have a lower Cl content than the starting base metal chloride. Preferably, mixing of the base metal chloride powder and control powder with the Al reducing agent powder is carried out in a controllable way to enhance reactivity between the reactants and achieve external control over reaction rates and the resulting exothermic heat. Under all conditions, the reactivity of the control powder with the base metal chlorides or the Al is lower than reactivity between base metal chlorides and Al.

Further example aspects of the invention will be apparent from the description below and the drawings, and from the claims.

IV. BRIEF DESCRIPTION OF THE DRAWINGS

Features and advantages of the present invention will become apparent from the following description of embodiments thereof, by way of example only, with reference to the accompanying drawings, in which:

FIG. 1: Temperature increases resulting from energy released by the exothermic reaction compared to the melting temperature of the base metals; Fe-2 denotes starting from $FeCl_2$ and Fe-3 denotes starting from $FeCl_3$.

Figure 2:
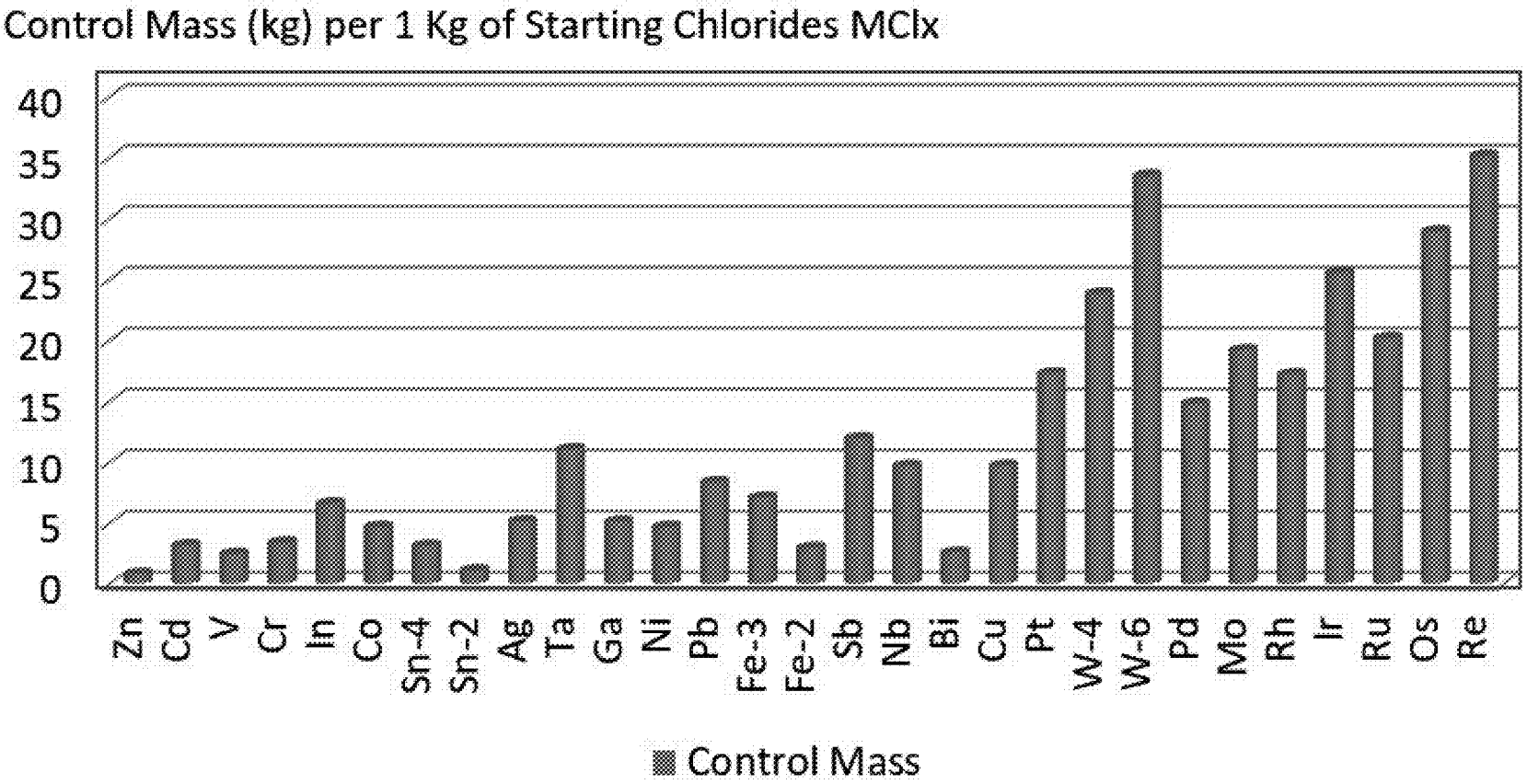

FIG. 2: Maximum amounts of control powder (base metal powder) required for limiting temperature increases due to exothermic energy to 200° C.

Figure 3:
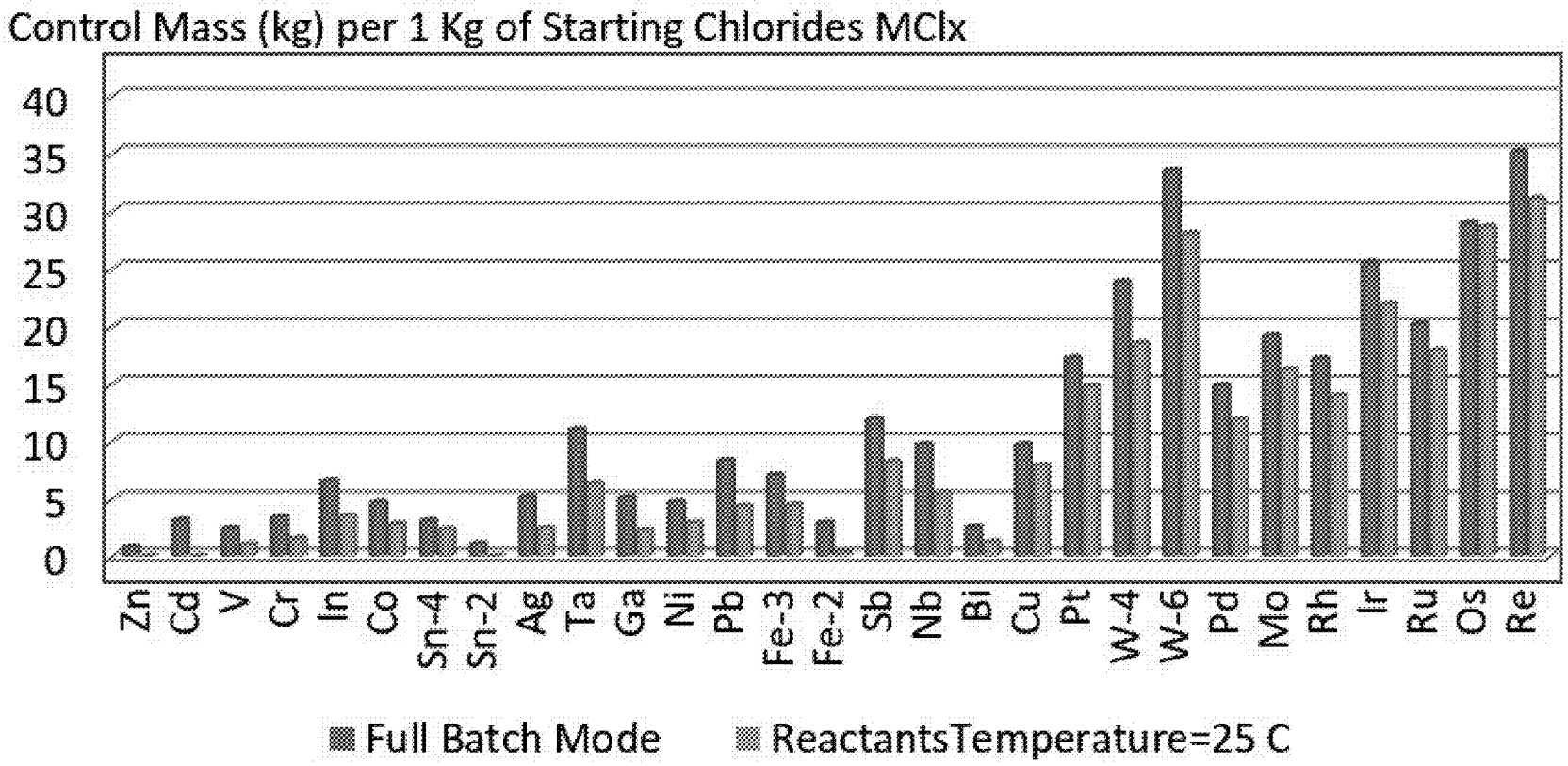

FIG. 3: Amounts of control powder (base metal powder) required for limiting temperature increases due to exothermic energy to 200° C., assuming reactants at 25° C. are fed into a reaction zone with control powder at a reaction temperature of 400° C.

Figure 4:
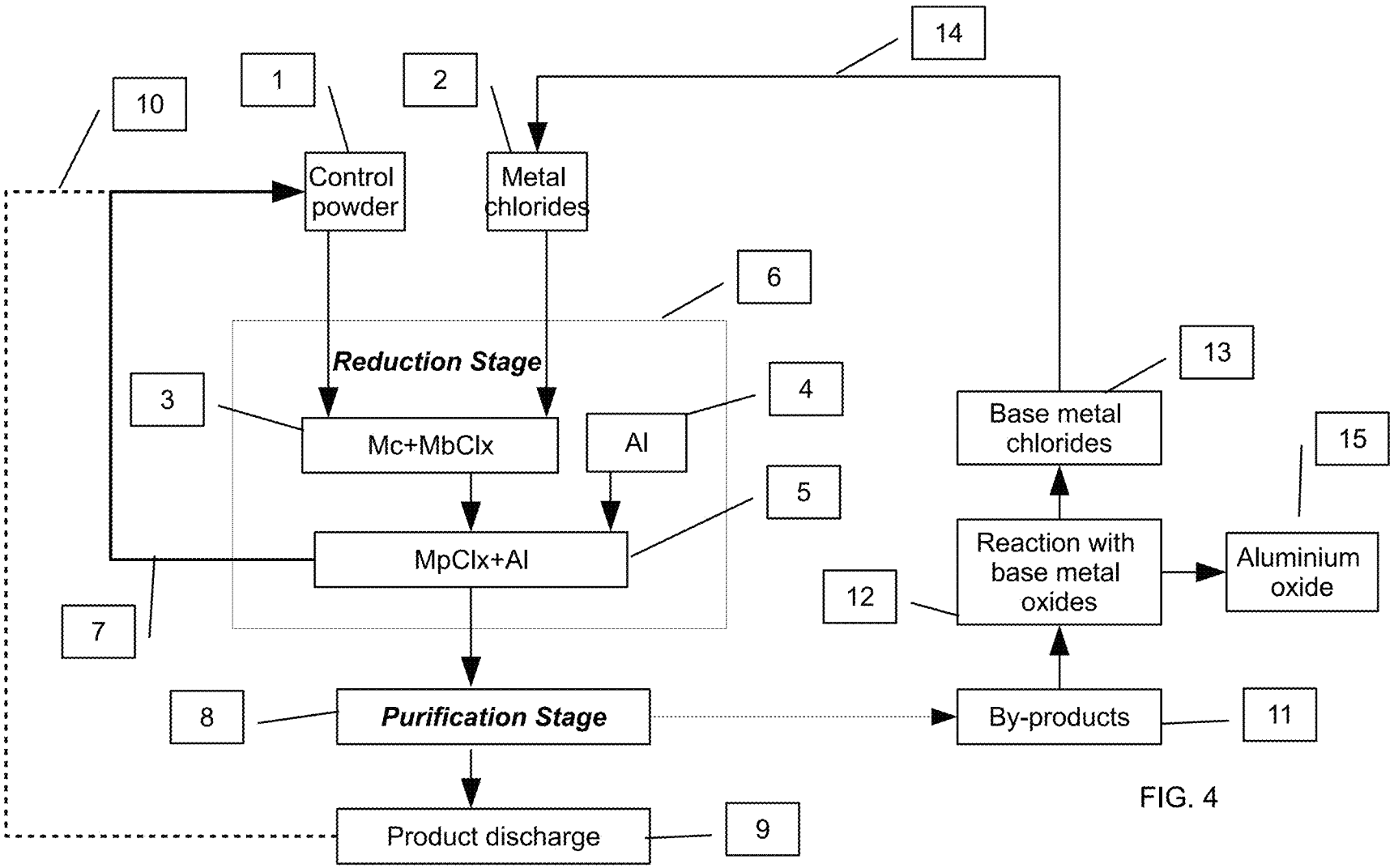

FIG. 4: A general block diagram illustrating basic processing steps of the method.

Figure 5:
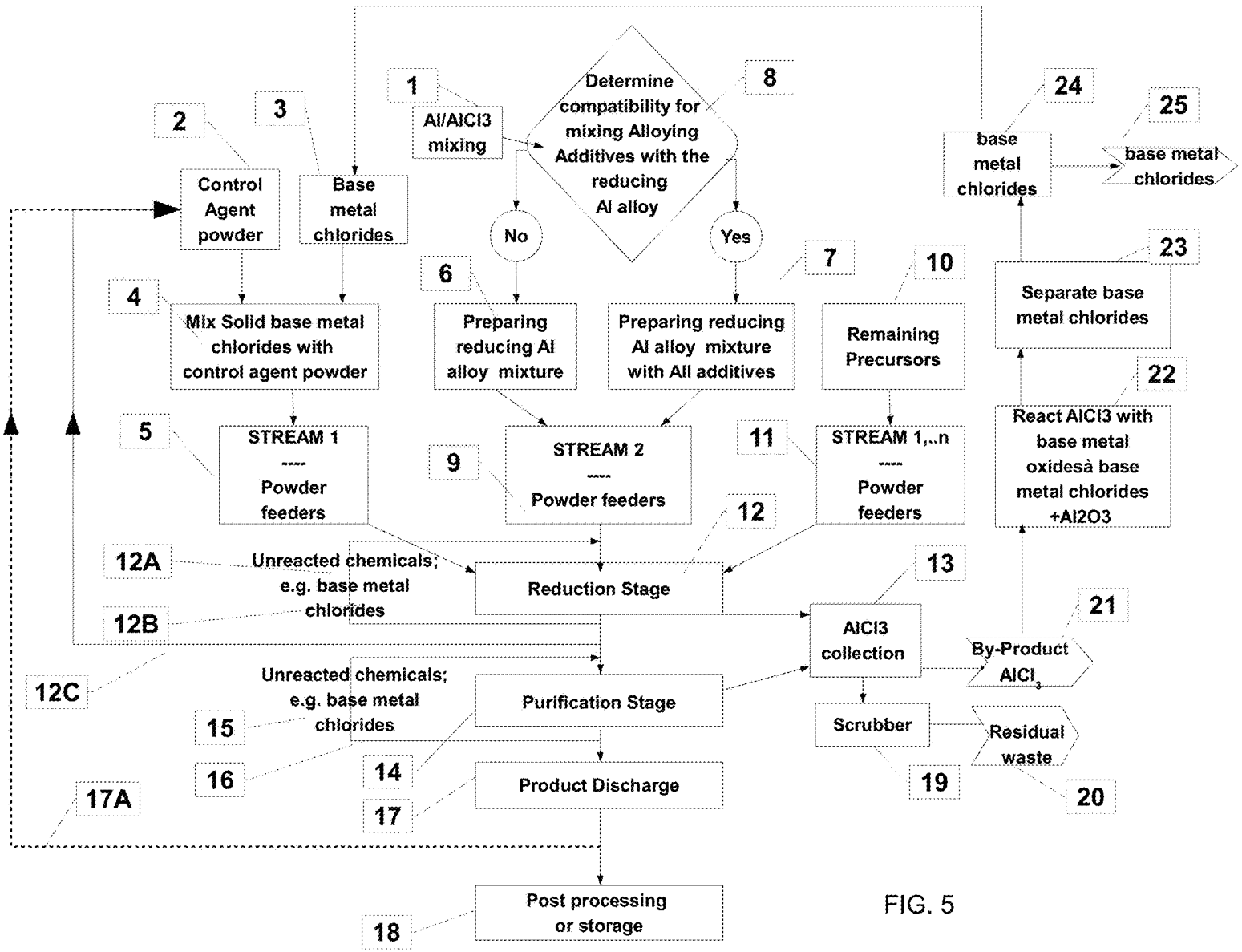

FIG. 5: A general block diagram illustrating one general embodiment of the method.

Figure 6:
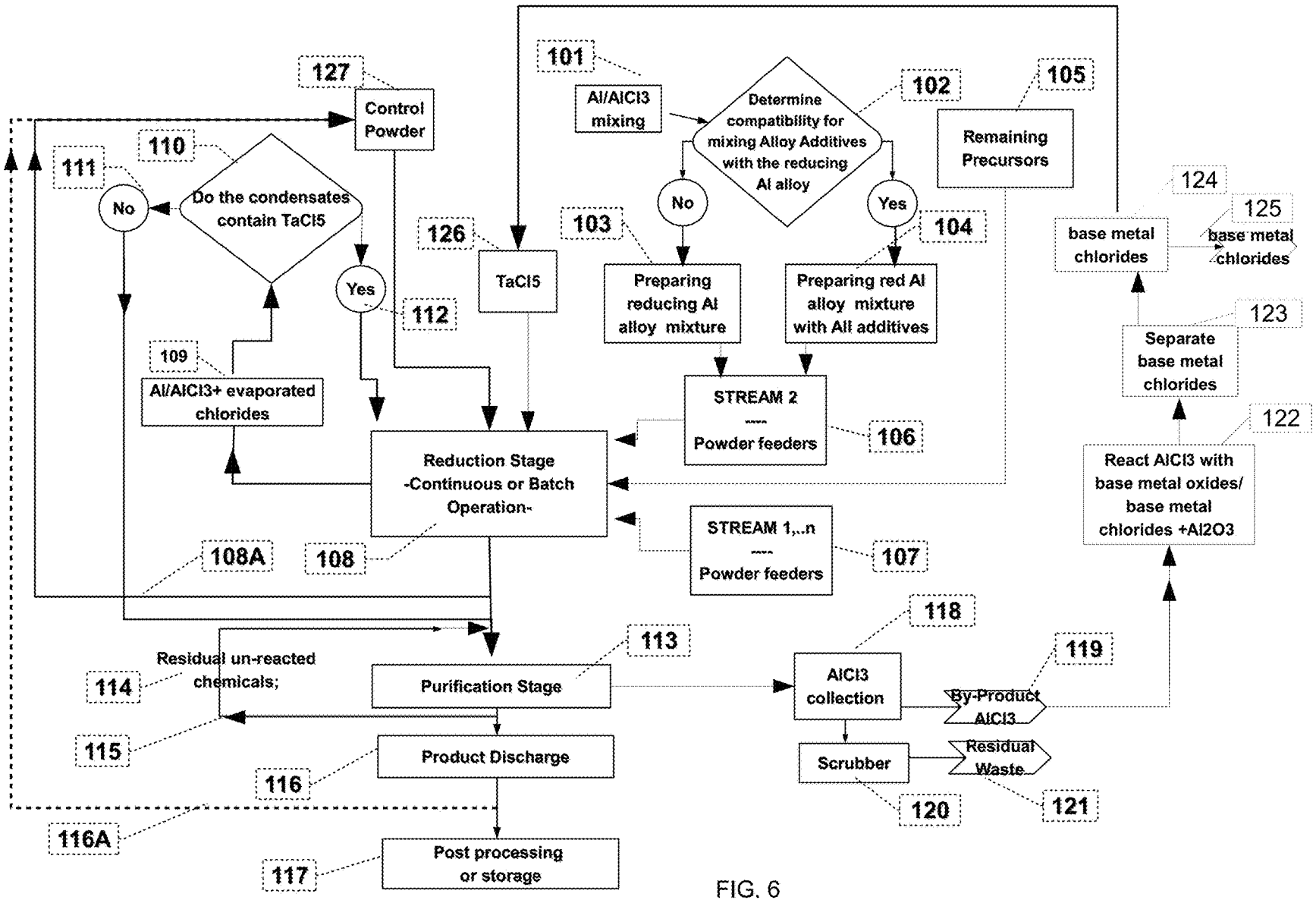

FIG. 6: A general block diagram illustrating one embodiment of the method including processing volatile chloride precursors (e.g. $TaCl_5$).

Figure 7:
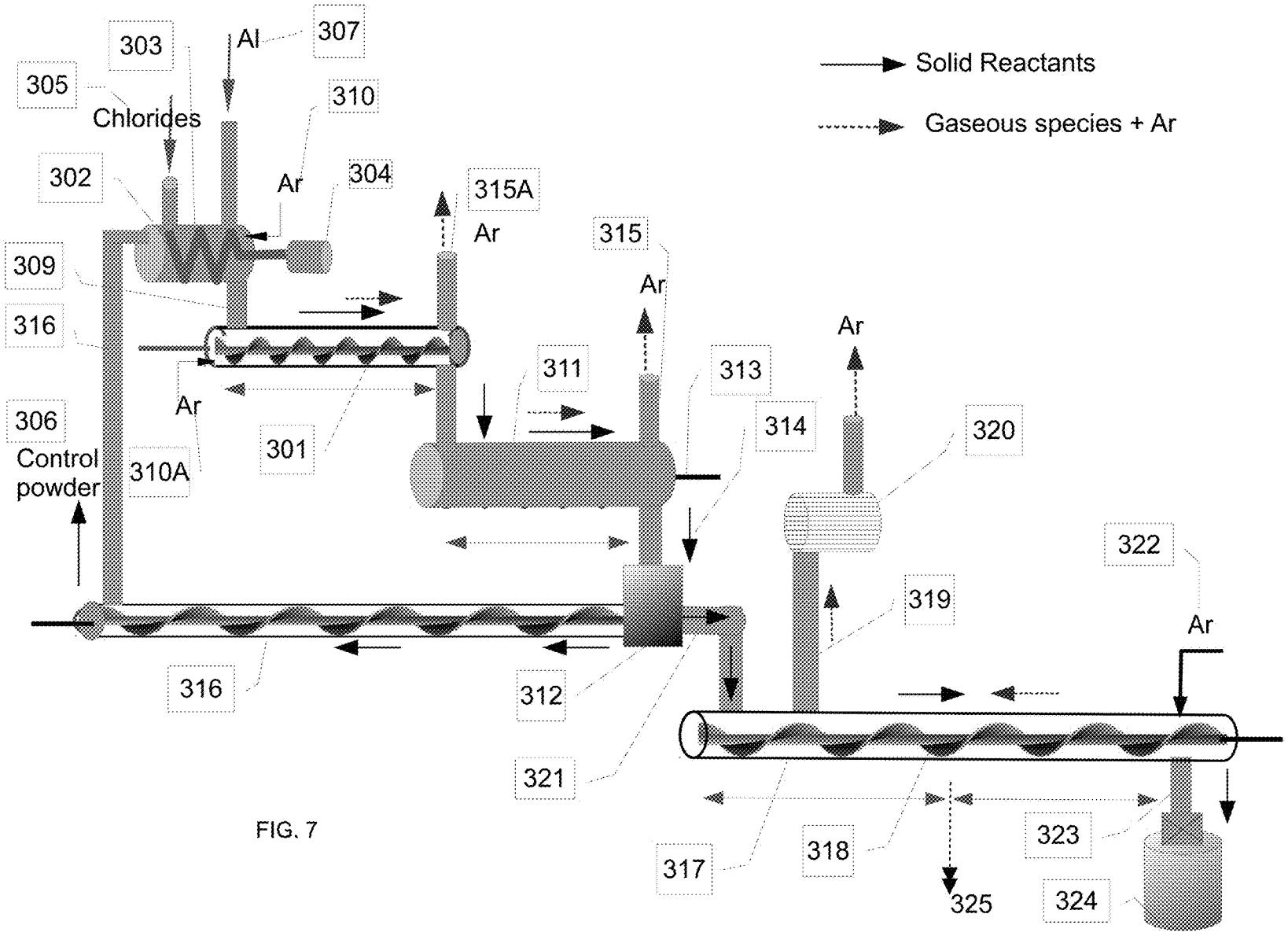

FIG. 7: A schematic representation of a reactor for carrying out the process in a continuous mode.

Figure 8:
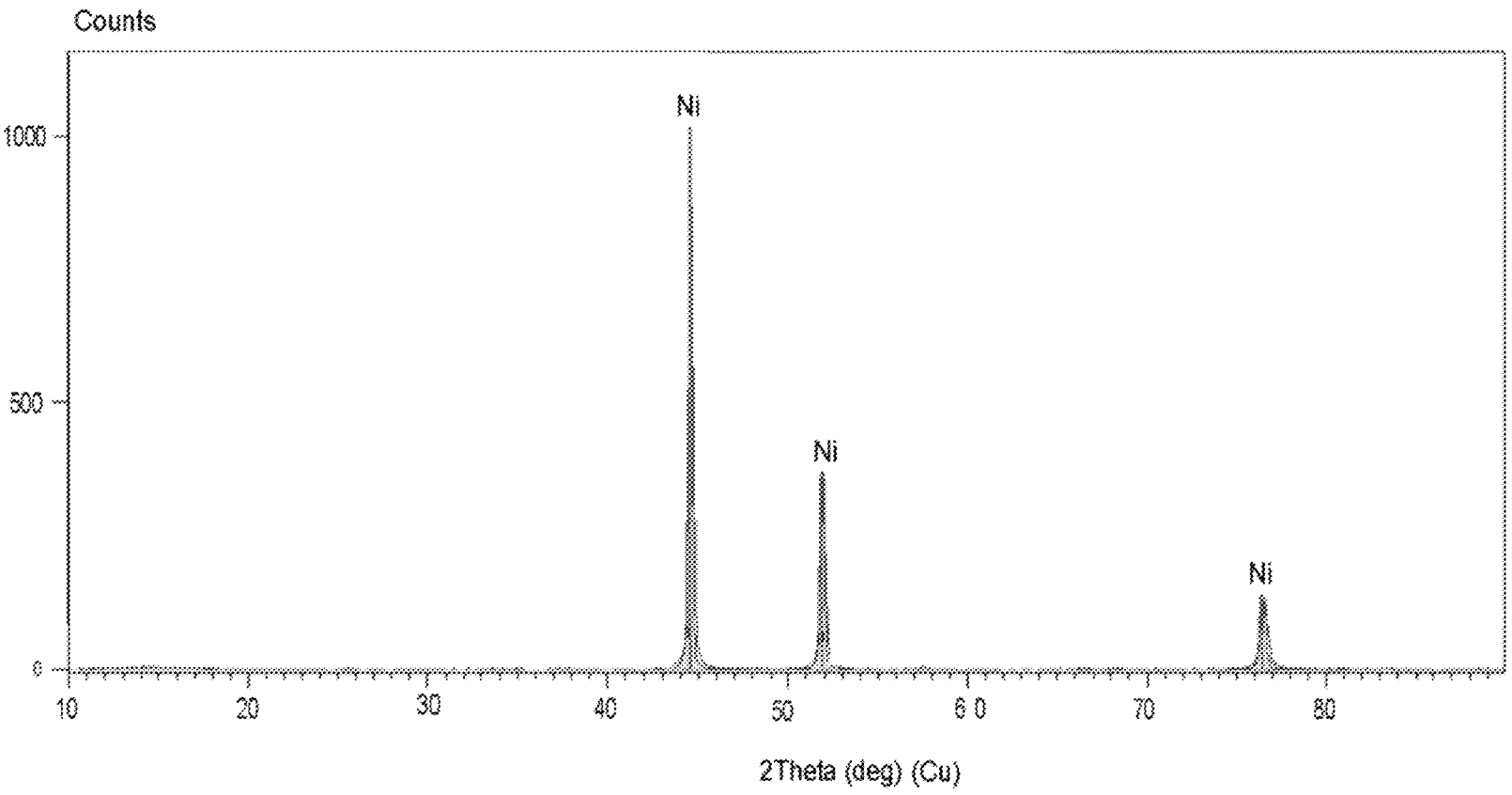

FIG. 8: An XRD trace for a sample of Ni powder product.

Figure 9:
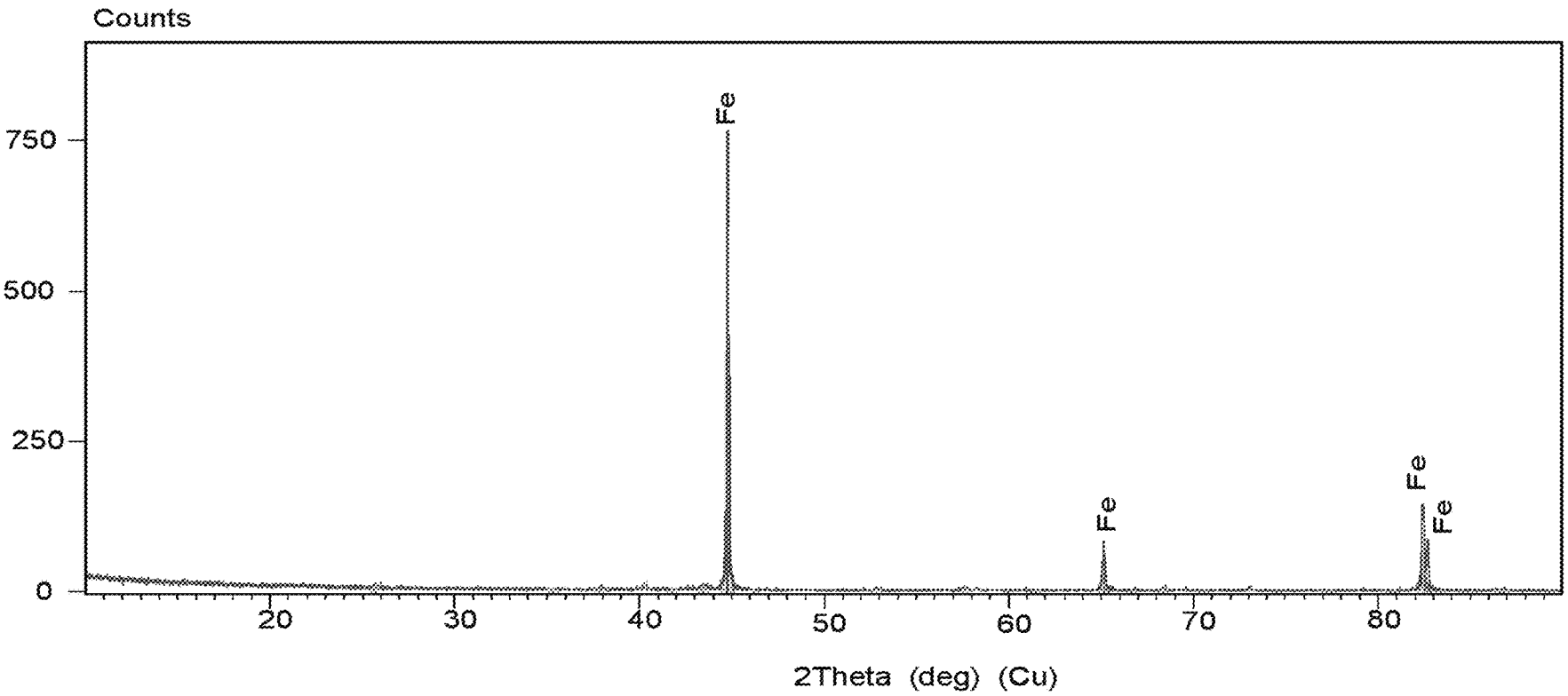

FIG. 9: An XRD trace for a sample of Fe powder product.

Figure 10:
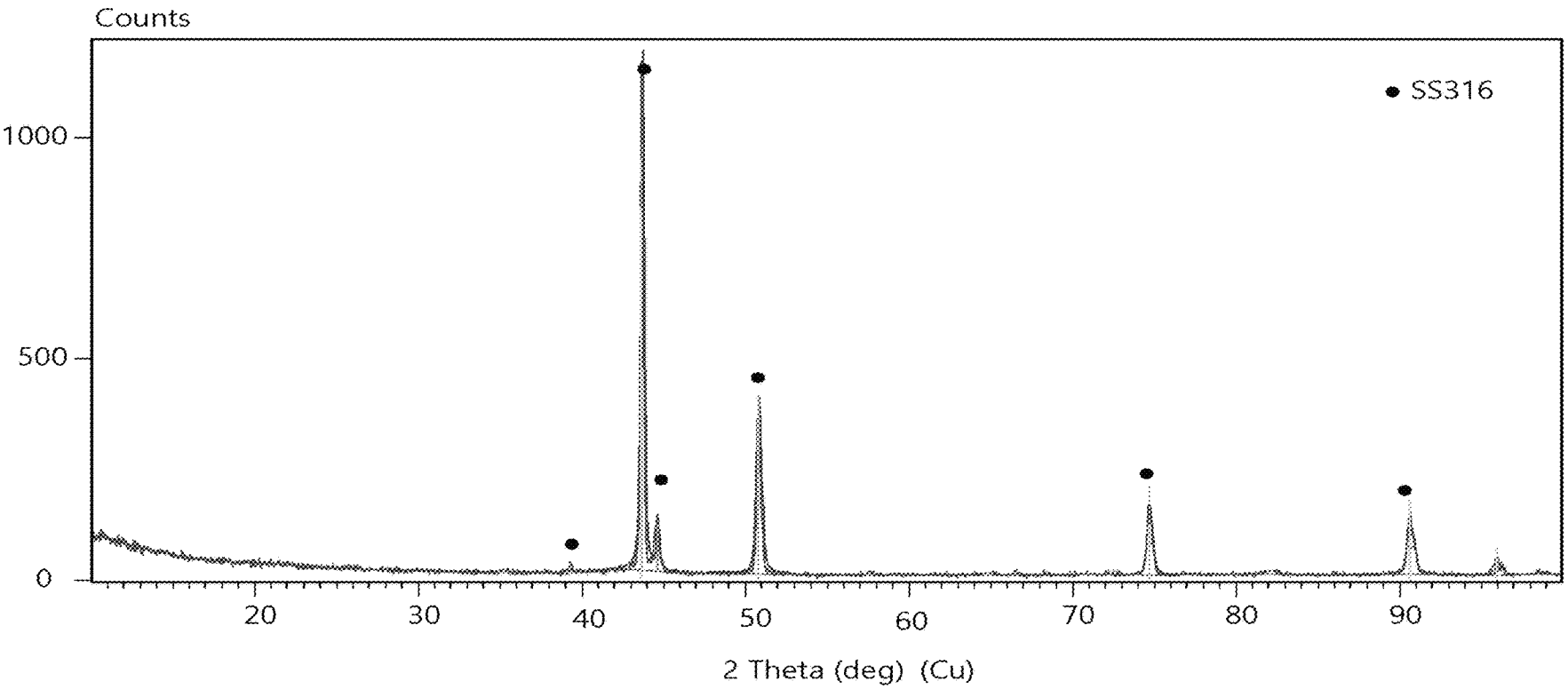

FIG. 10: An XRD trace for a sample of SS316 powder product.

Figure 11:
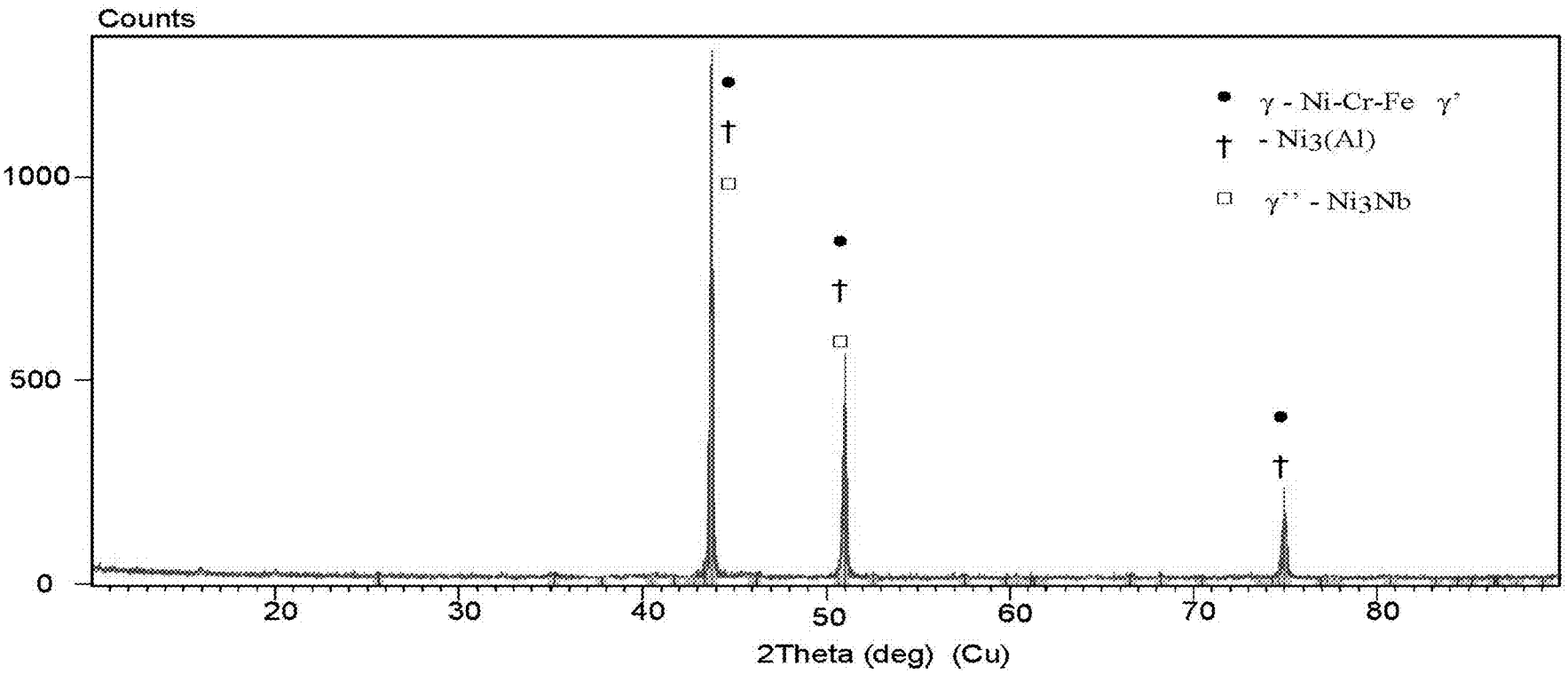

FIG. 11: An XRD trace for a sample of Inconel 718 powder product.

Figure 12:
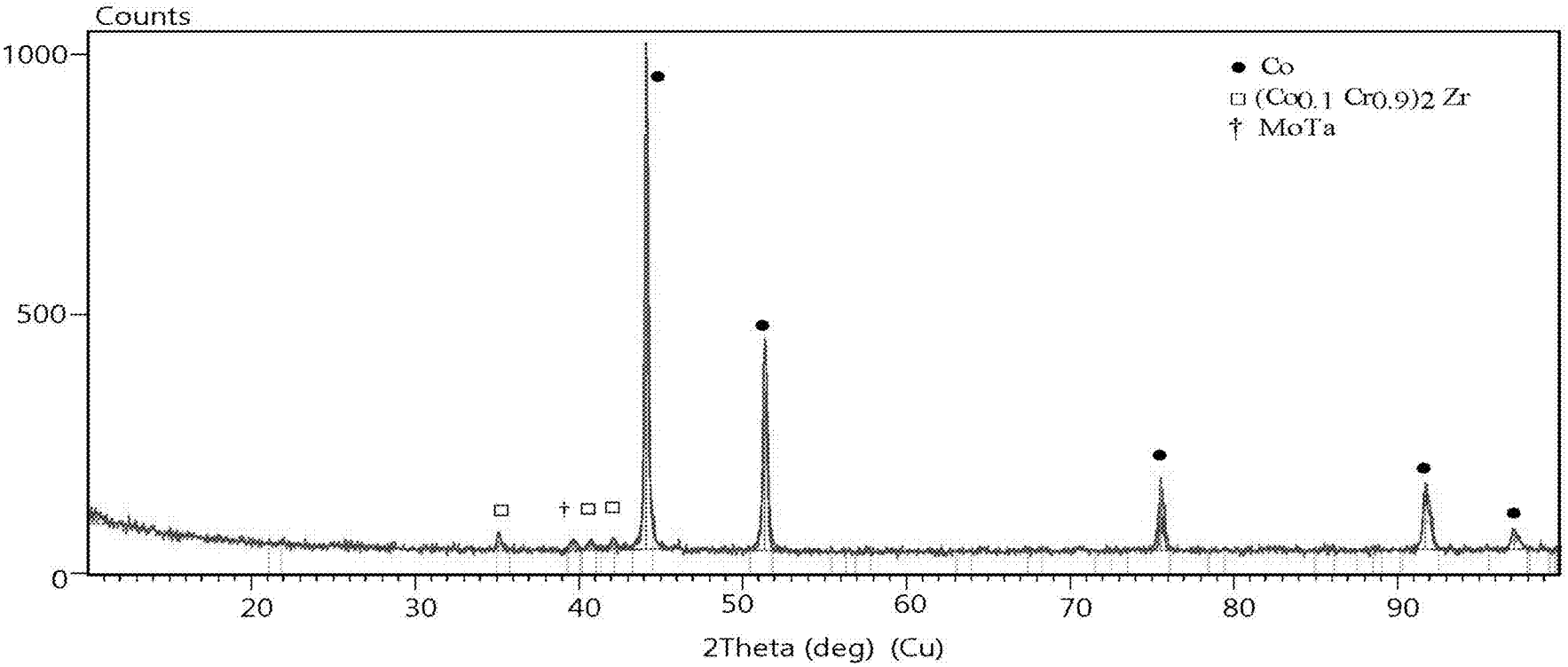

FIG. 12: An XRD trace of a sample of Co superalloy MAR-M-509.

Figure 13:
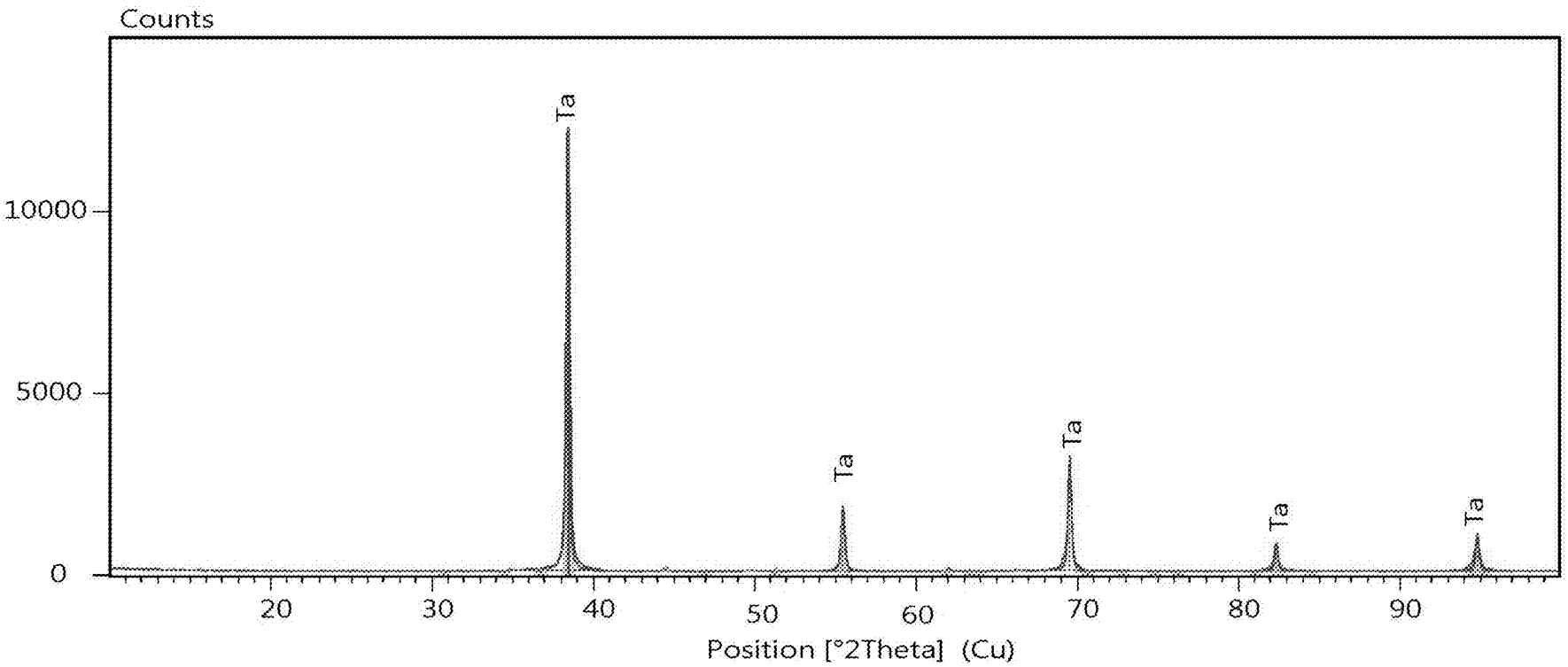

FIG. 13: An XRD trace for a sample of Ta powder.

Figure 14:
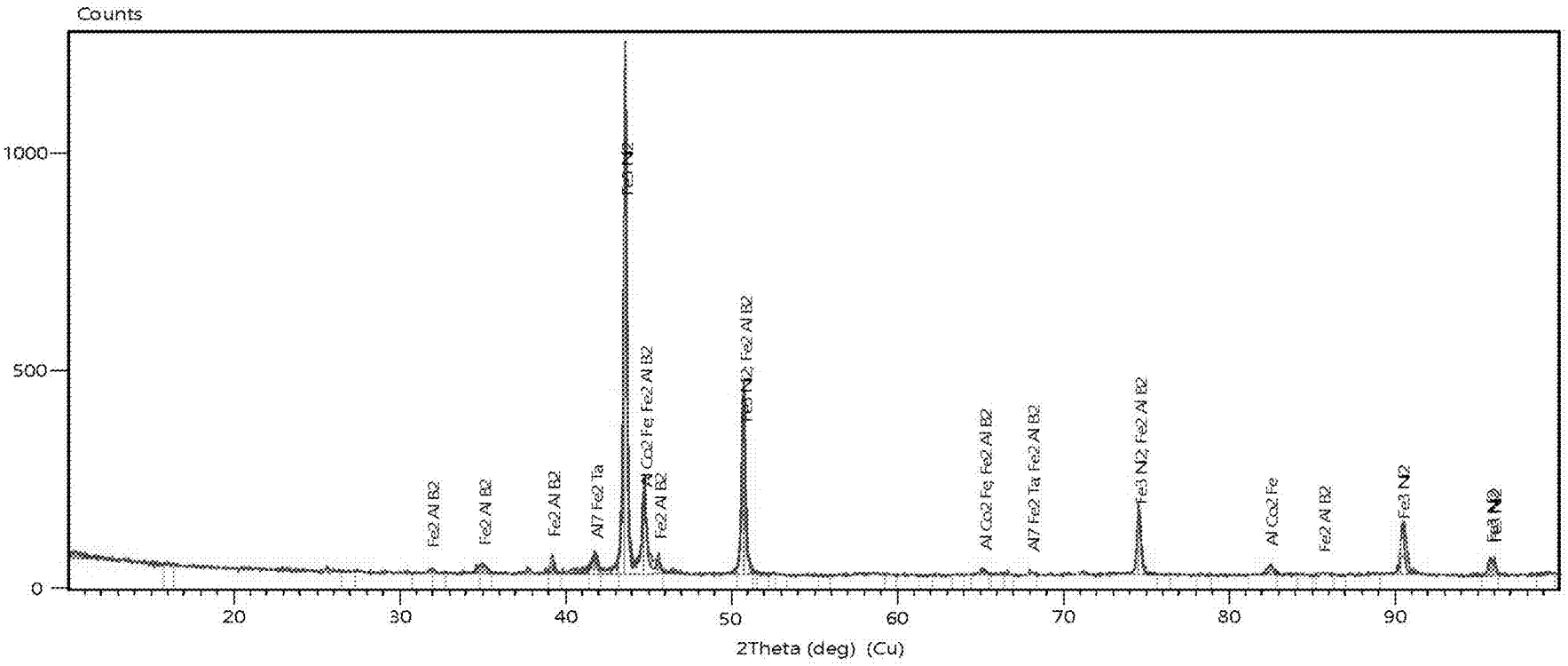

FIG. 14: An XRD trace for a sample of FeNiCoAlTaB.

Figure 15:
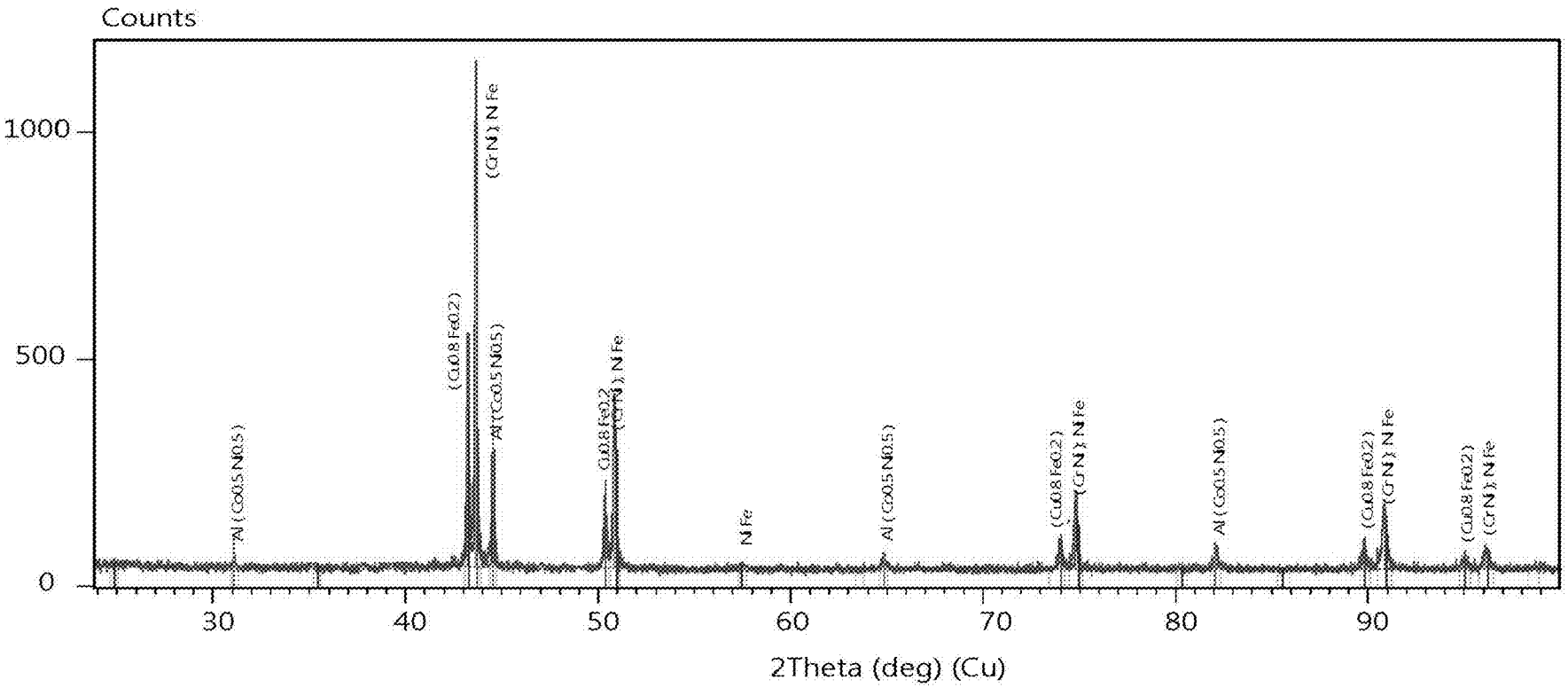

FIG. 15: An XRD trace for a sample of high entropy alloy (AlCoCrCuFeNi) powder product.

Figure 16:
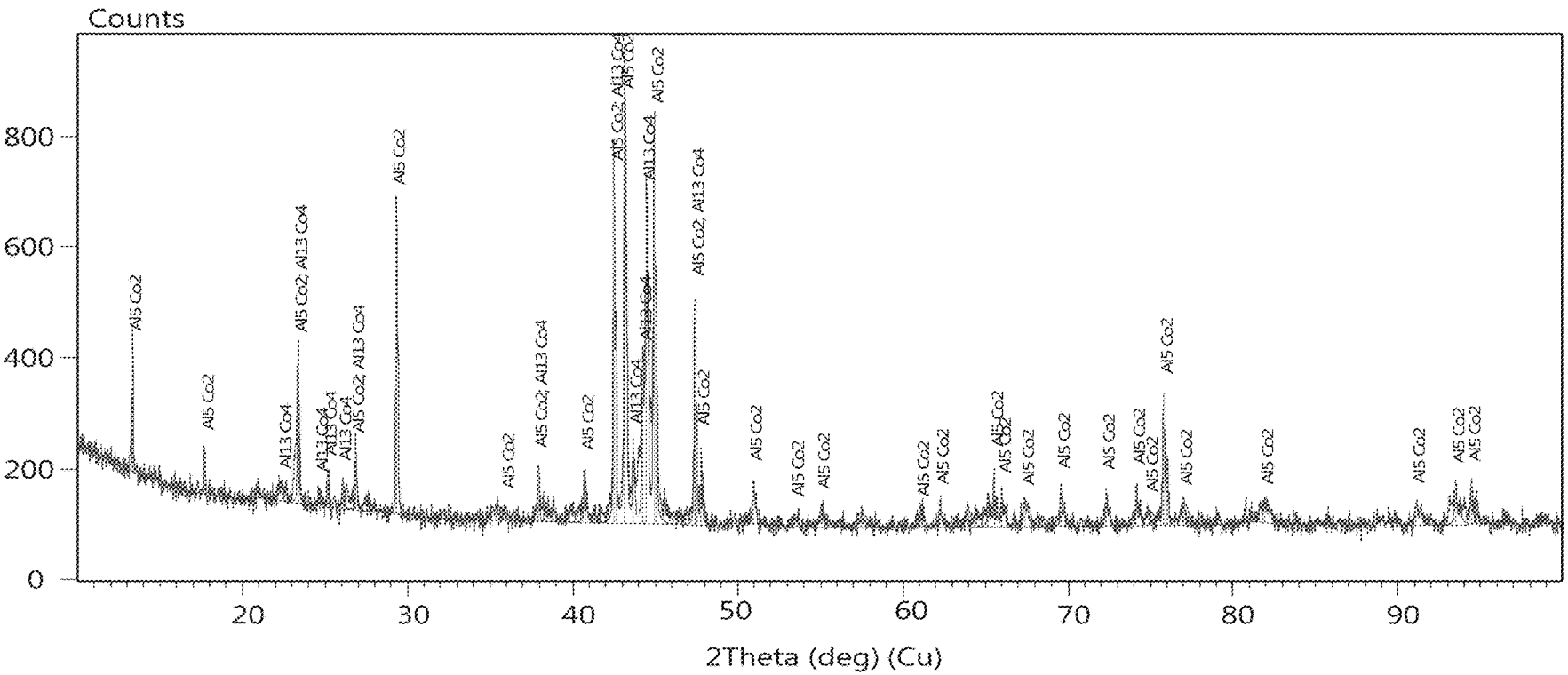

FIG. 16: An XRD trace for a sample of Al3Co.

Figure 17:
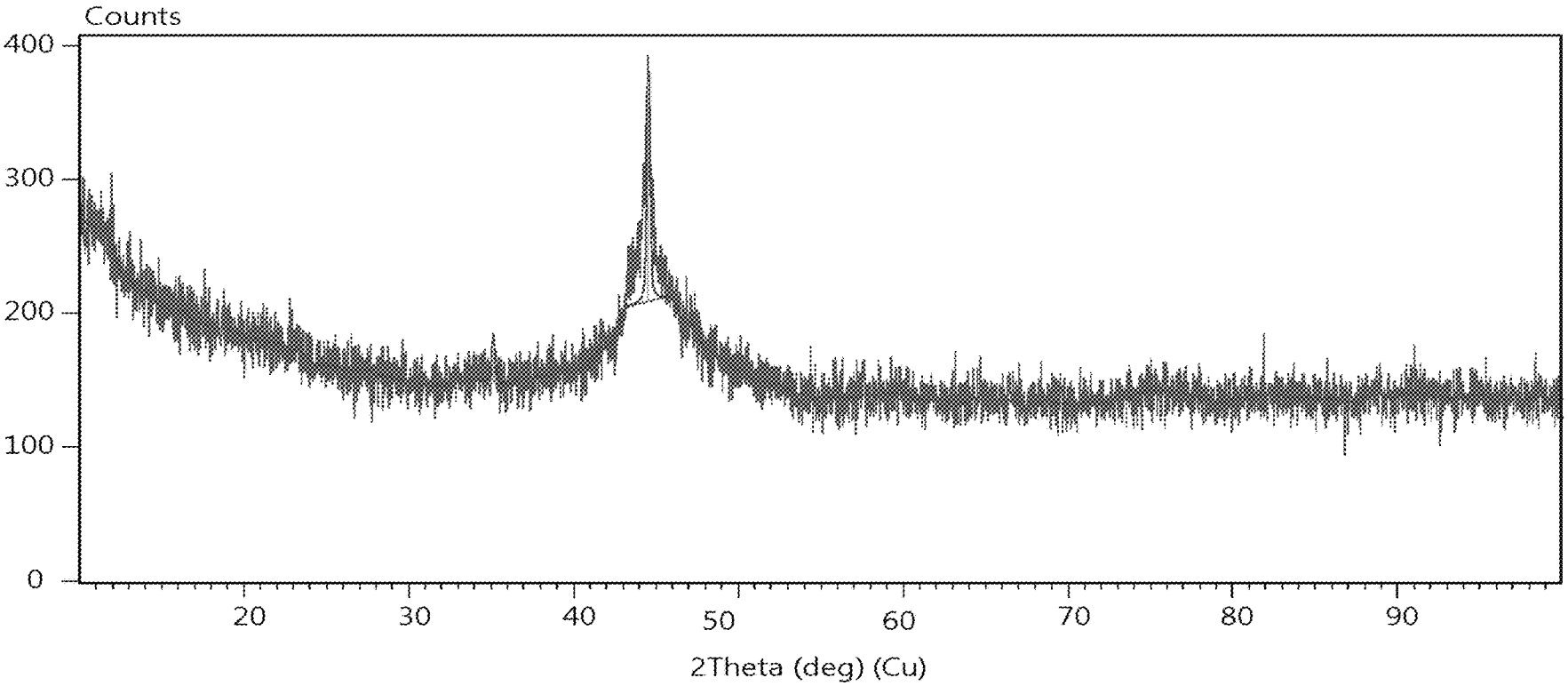

FIG. 17: An XRD trace for a sample Al3Co after washing in NaOH.

V. DETAILED DESCRIPTION OF PREFERRED EMBODIMENTS

TABLE 1 thermodynamic data corresponding to the base metals.

| 1 Base metal | 2 Melting point (° C.) | 3 Sub/Boil point (° C.) | 4 Starting Chemical | 5 ΔG (kJ/mole) at 400° C. | 6 Approximate Temp increases (° C.) | 7 Control Powder | 8 Control Mass (kg) |
|---|---|---|---|---|---|---|---|
| Zn | 419 | 907 | $ZnCl_2$ | −51 | 323 | Zn | 0.8 |
| V | 1910 | 3380 | $VCl_3$ | −124 | 1138 | V | 2.4 |
| Cr | 1907 | 2672 | $CrCl_3$ | −150 | 1377 | Cr | 3.4 |
| Co | 1495 | 2870 | $CoCl_2$ | −149 | 1662 | Co | 4.6 |
| Sn | 232 | 2270 | $SnCl_4$ | −359 | 2647 | Sn | 3.1 |
| Sn | 232 | 2270 | $SnCl_2$ | −133 | 1624 | Sn | 1.1 |
| Ag | 962 | 2212 | AgCl | −94 | 1711 | Ag | 5.1 |
| Ta | 3014 | 5425 | $TaCl_5$ | −293 | 1817 | Ta | 11. |
| Ni | 1455 | 2732 | $NiCl_2$ | −165 | 1935 | Ni | 5.1 |
| Fe | 1538 | 2750 | $FeCl_3$ | −289 | 2472 | Fe | 4.7 |
| Fe | 1538 | 2750 | $FeCl_2$ | −112 | 1250 | Fe | 7.1 |
| Nb | 2477 | 4742 | $NbCl_5$ | −358 | 2216 | Nb | 2.9 |
| Cu | 1084 | 2567 | $CuCl_2$ | −245 | 3036 | Cu | 9.7 |
| Pt | 1768 | 3827 | $PtCl_2$ | −288 | 3520 | Pt | 9.7 |
| W | 3407 | 5660 | $WCl_4$ | −482 | 3599 | W-4 | 17.2 |
| W | 3407 | 5660 | $WCl_6$ | −809 | 4311 | W-6 | 23.8 |
| Pd | 1555 | 1554 | $PdCl_2$ | −297 | 3642 | Pd | 33.5 |
| Mo | 2623 | 2617 | $MoCl_5$ | −634 | 3927 | Mo | 14.8 |

Table 1 presents a list of preferred base metals (Column 1) together with the corresponding melting and boiling temperatures (Column 2 and Column 3, respectively), the preferred starting chemical (Column 4) and the corresponding Gibbs free energy (ΔG) (Column 5) for reacting 1 mole of base metal chloride with Al at 400° C. according to (R1), the magnitude of temperature increases (Column 6) due to AG, the assumed control powder (Column 7) and the amount of control powder per 1 kg of starting base metal chloride (Column 8) required to limit the temperature rise to 200° C.

It can be seen in Table 1 that for all preferred starting chlorides, ΔG is negative, indicating that their reaction with Al per (R1) is exothermic and can result in excessive increases in the temperature of the products and the surrounding reactants as per the results in Column 6 showing the approximate increases in the temperature, ΔT, due to exothermic energy release. ΔT has been estimated by solving the equation:

$$\Delta G = \int_{T_r}^{T_r+\Delta T} (M_b C_{p-b} + M_{AlCl3} C_{p-AlCl3}) dT, \quad (1)$$

where, $T_r$ is the threshold reaction temperature, $C_{p-b}$ is the specific heat of the base metal, $M_b$ is the mass of the product $M_b$ per mole of starting base metal chloride $M_bCl_x$, and $M_{AlCl3}$ and $C_{p-AlCl3}$ are respectively the mass and specific heat of the resulting aluminium chloride by-product per mole of $M_bCl_x$. For the results in Table 1, it is assumed that exothermic energy release occurs in one step according to reaction R1 and the resulting heat is entirely absorbed by the resulting products ($M_b$) and by-product $AlCl_3$. Therefore, the calculations represent an extreme case wherein the control powder acts only as a thermal absorber. For multi-valence base metal chlorides and for multi-component products, the effects of dividing the reaction into two steps due to chemical reactions between the control powder and the chlorides can dominate and then thermal load associated with the process reduces.

The calculated temperature increases in Table 1 are compared in FIG. 1 to the melting temperatures of the corresponding base metals. It is seen there that the expected temperature increases are mostly higher than 190° C., and except for Zn, the increases are comparable or higher than the melting point of the base metal and they are all higher than the sublimation temperature of the corresponding chlorides. Thus, if the reaction was rapid, the resulting conditions have the potential to affect the reaction vessel, and this together with the excessive heat release and the super-heated gaseous by-product can result in hazardous behaviour.

The data in Table 1 shows that heat generated by the reaction of the precursor chlorides with Al can melt the Al reducing agent. If this occurs, it would cause formation of large particles of arbitrary aluminide phases, and slow down or stifle further reduction of the starting chemicals. Thus, there would be formation of alloys with a high content of aluminium and with a non-uniform composition. Therefore, it is also an objective of preferred forms of the present invention to provide mechanisms for controlling the amount of Al in the end-product and enables production of alloys with controllable Al content down to less than 10 wt % and preferably down to 0% Al.

The mass of the control powder (base metal powder for the results in Table 1) required per 1 kg of base metal chlorides is determined based on requirements for limiting temperature increases of the resulting products below a certain predetermined value. Table 1, Column 8 lists the maximum amount of base metal powder required to limit increases in the temperature of the reaction product to less than 200° C. above the externally set temperature for reactions involving the base metal chlorides in Column 4. For the results in Table 1, the reactants and the control powder are all assumed to be heated externally to the threshold reaction temperature—assumed to be 400° C. The results in Column 8 have been obtained by solving equation 2 for $M_c$ (mass of control powder):

$$M_c = \mathrm{Max}\left[0, \frac{\Delta G - \int_{T_r}^{T_r+\Delta T} (M_b C_{p-b} + M_{AlCl3} C_{p-AlCl3}) dT}{\int_{T_r}^{T_r+\Delta T} C_{p-b} dT}\right] \quad (2)$$

with ΔT=200° C.

The data in Table 1, Column 8, is plotted in FIG. 2 for ΔT=200° C. It can be seen there that the required amount of control powder ranges from ~1 kg of Sn powder per 1 kg of $SnCl_2$ to more than 20 kg of W per 1 kg of $WCl_6$. The data in Table 1 and FIGS. 1 and 2 assumes that the exothermic energy produced is entirely absorbed by the reactants with no heat losses due to any other effect and that all reactants and control powder are heated externally to the reaction temperature. As such, estimated values for both the expected temperature increases and the amount of control powder represent upper limit values for full batch mode processing.

According to some embodiments in the present disclosure, reactants at room temperature (25° C.) are gradually fed into a reaction zone containing the control powder at the reaction temperature. Therefore, the reactants would absorb energy to reach the reactant temperature and can contribute to limiting temperature increases due to exothermic energy generation. FIG. 3 compares the amounts of control powder required for the two configurations discussed here; full batch operation and gradual feeding of the reactants. It can be seen there that for some reactants, the room temperature reactant can have significant cooling effects.

Also, there exist other heat losses such as conduction through the reactor wall and heating/sublimation of diluents introduced with the reactants (e.g. $AlCl_3$). In some embodiments of the method, aluminium chloride is introduced with the reactants and with the control powder, and it then can play an important role in cooling reactants in the reaction zone and help control the temperature. Under most practical conditions, it would be expected that the amount of control powder required would be less than 50% of the amounts in Table 1. As stated before, the addition of control powder reduces the reaction rate between the reducible $M_bCl_x$ and the reducing Al, allowing for a more effective external cooling and for higher heat losses due to conduction and convection. Also, the amount of control powder required reduces with increases in the allowed temperature range, and if the acceptable maximum temperature 400° C. above the threshold reaction temperature, then the amounts of required control powder in Table 1 would be reduced by 50%.

It follows from the previous discussion that the reactants must still be externally cooled at a rate equivalent to heat generated by the reactants, but following the procedures described here allows for the cooling and overall heat management of the process to occur under mild conditions with only moderate increases in the reactant and vessel temperatures.

The inventor estimates that when the weight ratio of the control powder to the reducible base metal chlorides is equal to one, the reaction rate between the reducible precursors and Al reduces by a factor of 4, thus extending the reaction over longer periods and allowing for more effective energy management; as a result, there would be need for lower amounts of control powder.

Other factors that can affect the required amount of control powder include the threshold temperature of the reaction ($T_r$), the base metal characteristics, and the specific heat and total enthalpy of the base metal and the base metal chlorides. The control powder can be a mixture of different materials, but reactions between the control powder and the other reactants should not increase the thermal load resulting from the reacting system.

Accurate determination of the required amount of control mass requires analysis of all relevant processing conditions, accounting for the physical properties of the reaction vessel and for heat losses and cooling mechanisms available in the reaction zone. Estimates in Table 1 are provided only as guidance and variation in the listed numbers relative to specific experimental conditions would be apparent to a skilled addressee.

The inventor estimates that under practical conditions and with proper control over reactant flows and mixing, the amounts of control powder listed in Table 1 can be further reduced at least by a factor of between 2 and 5. In all embodiments, the amount of control powder should be between $M_c/100$ and $M_c$ where $M_c$ is defined by equation (2).

The control powder can be added in several ways depending on the reactor configuration. In one embodiment, the control agent is mixed with the starting base metal chlorides before reacting with the Al reducing agent. In another embodiment, the control agent is mixed with the Al reducing agent before reacting with the starting base metal chlorides. In a third embodiment, the control agent, the reducible base metal chlorides and the Al reducing agent are fed separately into the reaction zone where they get mixed and reacted. The choice of a suitable arrangement depends on the relative reactivity between the control agent and the reducible chlorides and the reducing Al. In a preferred embodiment, the control powder is a fully processed product or a semi-processed product of the reaction between the base metal chlorides and the Al alloy. In another preferred embodiment, the control powder is the base metal alloy product and is produced in-situ.

The inventor finds that if no control agent is added, the hot by-products generated by the reaction can cause significant increases in the pressure with rapid gas movements, that may blow the reactants out of the reaction zone. If the control powder had a lower reactivity with the reactants and if it existed in quantities larger than the reactants, then the reactants would be distributed into localised small sites within the control powder matrix wherein each site is surrounded by control powder. When the reaction occurs, gaseous by-products accelerated out of the localised reaction sites collide with the surrounding control powder, transferring their kinetic energy to the powder and causing significant mixing throughout the reactants body. The inventor found that even with a very limited mixing between the reducible chlorides and the reducing Al powder, the reaction efficiency is significantly enhanced by self-mixing generated by the by-product gas micro-flows. As discussed below, for most of the base metals and base metal chlorides subject of the present invention, temperature increases in the reaction products generated by the exothermic energy release exceeds 200° C. above the threshold reaction temperature $T_r$. Thus, the resulting local pressure at the localised reaction sites is more than 1.01 atm and is likely to be more than 1.1. This would generate fast localised gas flows (short bursts) within the reactant body with velocities up to more than a hundred meters per second, inducing significant mixing within the reactant body and playing a key role in transferring exothermic energy released by the reaction away from the local reaction sites and the immediate surrounding control powder.

The inventor found that for a pure Al powder (with an average particle radius R), and with a ratio $[M_bCl_x]/[Al]=a$ and a ratio $[M_c]/[M_bCl_x]=b$, and with a reactant packing density D (reactants are $M_c$, $M_bCl_x$ and Al), local increases in pressure due to fast reactions between the base metal chlorides and Al can be expressed as $$\Delta P = \frac{D\ N\ \Delta N_{Al}}{27N_{Ar}(1+a+ab)},$$

where N is Avogadro's number, $N_{Ar}$ is the number density of Ar at the reaction temperature and $\Delta N_{Al}$ is the amount (number of atoms per $cm^3$) of Al that reacted. The inventor found that even for one per thousand of the available Al reacting ($\Delta N_{Al}/N_{Al}=0.001$), the resulting increases in the localised pressure can be up to 0.25 atm. For $\Delta N_{Al}N_{Al}=1\%$, ΔP can be up to 2.5 atm with the localised pressure reaching 3.5 atm.

The weight ratio of the solid base metal chlorides to the control powder may be determined based on tolerable increases in the temperature of the products that can result from the exothermic energy release. It is preferable that heat generated by the exothermic reaction does not increase the temperature of the products in the reaction zone higher than the melting point of the base metal. It is preferable that that heat generated by the exothermic reaction does not increase the temperature of the products in the reaction zone higher than the melting point the Al reducing agent.

In one embodiment, temperature increases resulting from exothermic heat generated by the reaction of the base metal chlorides and the Al is limited to less than 600° C.

In another embodiment, temperature increases resulting from exothermic heat generated by the reaction of the base metal chlorides and the Al is limited to less than 400° C.

In a third embodiment, temperature increases resulting from exothermic heat generated by the reaction of the base metal chlorides and the Al is limited to less than 200° C.

In a preferred embodiment, the present invention provides a method for production of base metal alloys in a powder form, comprising the steps of:

- preparing a first Stream (Stream 1) of materials from a mixture of a predetermined amount of precursor chemicals including at least one solid base metal chloride and optionally including precursor materials for alloying additives; and
- preparing a stream of materials (Stream 2) containing primarily the Al reducing agent and optionally including precursor materials for alloying additives; and
- preparing control powder (Stream 3). The control agent is preferably but not necessarily the base metal of the starting base metal chloride; and
- the Reduction Stage: feeding predetermined amounts of Stream 1 and Stream 2 into a first reaction zone containing a predetermined amount of Stream 3, and
  - process the resulting mixture at externally set temperatures between $T_0$ and $T_1$ to reduce at least a part of chemicals in Stream 1 and produce an intermediate product, wherein this processing step includes mixing, stirring and heating; $T_0$ is above 25° C. and is preferably above 160° C. and more preferably above 200° C. and $T_1$ is below 1000° C. and preferably below 660° C. and more preferably below 600° C. and still more preferably below 500° C.; and
  - the reaction zone is arranged in use to remove heat generated by the reaction and limit the overall reactant temperature to a temperature $T_m$; $T_m$ is preferably below the melting point of the Al reducing agent (for pure Al, $T_m$ is less than 660° C.); and
  - materials evaporated from the first reaction zone are condensed elsewhere at lower temperatures and recycled; and,
  - means are provided for additional controlling mechanisms to control mixing and feeding rates; and
  - solid intermediate products from the Reduction Stage may include residual unreacted base metal chlorides and residual reducing Al and solid $AlCl_3$; and,
  - base metal species in the control powder has a Cl content less than 50% and preferably less than 75% of the starting base metal precursors.
- optionally recycle all or a part of the intermediate products through the Reduction Stage as a control powder; and
- the Purification Stage: processing solid products from the Reduction Stage in a second reaction zone at temperatures between $T_2$ and $T_{max}$ to purify the intermediate products from the Reduction Stage, and complete the reduction reaction and evaporate and/or sublimate unreacted materials within the solid reactant mixture; $T_2$ is preferably above 200° C. and $T_{max}$ is preferably below 1100° C.; and continuously remove the by-products away from reactants and collect and recycle reducible chemicals evaporated from the high temperature zone; and modulate $T_{max}$ and the residence time to control the particle size and the degree of agglomeration of the end products; and
- separate the base metal alloy powder from residual unreacted materials and carry out post processing; and
- all reactions between the reducing Al and stable chloride species based on $M_b$ and Cl ($M_bCl_{1-n}$) are exothermic at all processing temperatures between 25° C. and $T_{max}$.

The maximum set temperature in the Reduction Stage, $T_1$, is determined by factors including the kinetics barrier of reactions between the precursor material and the Al reducing agent and the characteristics of the reactants such as the purity and particle size of the Al alloy powder. Preferably, $T_1$ is below the melting temperature of Al and more preferably below 600° C. By way of an illustrative example only, if nickel was the base metal and $NiCl_2$ was the reducible base metal chloride, then the Stage1 maximum set temperature would be below 500° C.

The maximum set temperature in the Purification Stage, $T_{max}$, is determined by factors including the morphology and composition of the end-product in addition to the requirement of evaporating any residual un-reacted chemicals remaining within the solid products. Preferably, $T_{max}$ is set at a temperature slightly above the highest sublimation/evaporation temperature of the base metal chlorides being processed. If nickel was the base metal and $NiCl_2$ was the reducible base metal chloride, then $T_{max}$ is below 900° C.

In one preferred embodiment, the Al reducing agent is pure Al. In another embodiment, the Al reducing agent is pure Al alloyed with other elements. The Al reducing agent is preferably a powder or flakes in a fine particulate form.

In one preferred embodiment, aluminium chloride is mixed with Al to form an Al—$AlCl_3$ mixture corresponding to between 10 wt % and 500 wt % of the weight of the base metal chlorides. Including $AlCl_3$ helps dilute and spread the Al more uniformly when the Al—$AlCl_3$ is mixed with the base metal chloride and increase the contact surface area with the chloride and thus increase reaction efficiency. Also, the $AlCl_3$ can act as a coolant to the reactants in the Reduction Stage.

In one embodiment, by-products from the Reduction Stage together with any base metal compounds escaping with the gaseous by-products are collected and returned for processing in the Reduction Stage. In one variation of this embodiment, the recycling process is carried out continuously. In another variation, the collected materials are mixed with products obtained at the end of the Reduction Stage and then the resulting mixture is reprocessed though the Reduction Stage as described before. In still another variation, a part of the intermediate products from the Reduction Stage are used as a control powder. In one form of this variation, the intermediate products include $AlCl_3$.

In all preferred embodiments, the reducible solid precursor is a metal halide (preferably chloride) or a mixture of metal halides of the base metals. Examples of preferred starting chlorides include $ZnCl_2$, $VCl_{(2,3)}$, $CrCl_{(2,3)}$, $COCl_2$, $SnCl_2$, AgCl, $TaCl_{(4,5)}$, $NiCl_2$, $FeCl_{(2,3)}$, $NbCl_5$, $CuCl_{(1,2)}$, $PtCl_{(4,3,2)}$, $WCl_{(4,5,6)}$, $PdCl_2$ and $MoCl_5$ respectively corresponding to base metals of Zn, V, Cr, Co, Sn, Ag, Ta, Ni, Fe, Nb Cu, Pt, W, Pd, and Mo. The solid base metal chlorides are preferably in the form of a finely divided particulate powder and their reduction is carried out through reactions with a control powder based on Zn, V, Cr, Co, Sn, Ag, Ta, Ni, Fe, Nb Cu, Pt, W, Pd, and Mo in a fine particulate form and a solid Al alloy also in a fine particulate form. In a preferred embodiment, the solid base metal chlorides have an average grain size less than 100 microns and preferably they are in the form of a powder or flakes in a fine particulate form.

In one embodiment, the base metal chlorides are mixed/milled to homogenise the compositions.

In one embodiment, the base metal chlorides are mixed with an $AlCl_3$. The mixing can be carried out by co-milling.

In one embodiment, the base metal chlorides are mixed with an $AlCl_3$ to produce at least one eutectic phase based on base metal chloride-$AlCl_3$. The mixing can be carried out by co-milling.

In one embodiment, the base metal chlorides are mixed with an $AlCl_3$ to increase dilution of the base metal chlorides within the reactant matrix. The mixing can be carried out by co-milling.

Alloying additives can be included through precursor chemicals in the reactant streams or through a separate additional stream if necessary depending on compatibility with the solid base metal chlorides and the Al reducing agent. The alloying additives may be a compound or a mixture of compounds or elements based on one or more elements from the periodic table such as O, N, S, P, C, B, Si, Mn, Al, Ti, Zr and Hf. Addition of the alloying additives can be done through various means and at various points during the process during the Reduction Stage or the Purification Stage. Preferably, the additive precursors are in the form of halides.

Alloying additives that do not meet the exothermicity criterion can present difficulties and may require special procedures to be incorporated properly. For example, additives such as Ti, Mn and Zr can act as reducing agents for the base metal chlorides, degrading the end-product and causing retention of excessive levels of Al together with impurities of Ti chloride, Mn chloride and Zr chloride. Alloying additives based Ti, Mn and Zr may be included only if Al can be tolerated as a part of the end-product composition, and then particular care needs to be taken to prevent formation of segregated aluminide phases, accommodate for losses of $TiCl_x$, $MnCl_x$ and $ZrCl_x$ and minimise presence of unreacted chlorides in the end-product.

In one embodiment of the method for producing alloy compositions including additives Ti, Mn, Zr and Al, chlorides of Ti, Mn and Zr are first reacted partially or fully with a reducing agent and then the resulting products are thoroughly mixed and processed with the other reactants at temperatures above 700° C.

In one embodiment, the Reduction Stage is operated in a batch mode. In another embodiment, the Reduction Stage is operated in a continuous or a semi continuous mode.

In one embodiment where the Reduction Stage is operated in a batch mode, in continuous mode or in semi-continuous mode, intermediate products from the Reduction Stage are used as a control powder. In one form of this embodiment, the control powder is produced in-situ. In yet another form, end-products are used as a control powder.

In one embodiment, intermediate products from the Reduction Stage are not transferred into the Purification Stage until the Reduction Stage operation is concluded. In another embodiment, intermediate products from the Reduction Stage are continuously transferred into the Purification Stage.

In one embodiment for production of alloy powder with an Al content higher than 15 wt %, the Reduction Stage is preferably operated in a mode wherein the Al reducing agent is fed at a rate corresponding to that required for reducing the base metal chlorides to their pure elemental base metals with no excess Al, and then after the total amount of the base metal chlorides have been dispensed, the remaining Al alloy powder is fed at a rate so that the resulting temperature of the Reduction Stage reactants is less than 660° C.

In one embodiment, wherein the starting precursor materials have a low boiling/sublimation temperature lower than the Reduction Stage reaction temperature, the method comprises an internal recycling step in the Reduction Stage, where the Reduction Stage reactor is arranged in use to condense and collect reactants emanating from the reaction zone and return them for recycling. In one form of this embodiment, materials condensed and returned to the reaction zone can include aluminium chloride. The Reduction Stage products are then processed through the Purification Stage according to any of the foregoing or forthcoming aspects and embodiments.

In one embodiment, the Purification Stage is operated in a batch mode. In one embodiment, the Purification Stage is operated in a continuous mode.

In one embodiment, the ratio of Alto the reducible chemicals is lower than the stoichiometric ratio, and thus there would be an excess of reducible chemicals in the starting materials. The excess reducible chemicals are evaporated during the Purification Stage processing, and then they are collected and recycled.

In one embodiment, unreacted precursor materials processed through the Purification Stage at temperatures up to $T_{max}$ are evaporated and condensed in regions at lower temperatures, and then continuously recycled through either through the reduction Stage or the Purification Stage as described before. In one for form of this embodiment, the recycling is done in a continuous form.

In all preferred embodiment, the reactants are not mixed beforehand as there can be intrinsic reactions leading to generation of a large amount of heat with possible pressure build-up due to overheating of gaseous aluminium chloride by-products generated by the reaction.

In any of the embodiments, the method can comprise a pre-processing step for forming solid metallic subchlorides to be used as starting precursor materials.

When the starting chloride is a liquid or a gas, then the method can comprise a primary step for reducing the primary chloride to produce a lower valence chloride. For example, when Sn is the base metal and $SnCl_4$ is the preferred starting chemical, the method includes the primary step of reducing $SnCl_4$ to $SnCl_2$. This can be carried out using various routes, including reduction with alkali metals and reduction with hydrogen at high temperature.

Preferably, this primary reduction step is carried out using reduction with Al according to $$M_bCl_x(l,g)+(x-z)/3Al \rightarrow M_bCl_z(s)+(x-z)/3AlCl_3 \quad (R4)$$

and then the resulting solid $M_bCl_z(s)$ which may include residual Al is used as a solid precursor materials as described above. $M_bCl_x(l,g)$ is the liquid/gas chloride and $M_bC_z$ (s) is the solid chloride.

In one preferred embodiment, the primary starting chloride has a boiling/sublimation temperature comparable to or lower than the threshold reaction temperature in the Reduction Stage, and then the method can comprise a pre-processing step for forming solid metallic subchlorides to be used as starting precursor materials. In one form of this embodiment to produce alloys based on Fe, Ta, Mo, Nb, W, and V, the starting precursor materials including $FeCl_3$, $TaCl_{(4\ or\ 5)}$, $MoCl_5$, $NbCl_5$, $WCl_{(4,6)}$, and $VCl_{(3,4)}$ are first reduced to produce a mixture including subchlorides (i.e. $FeCl_2$, $TaCl_{(2,3,4)}$), $MOCl_{(2,3)}$, $NbCl_{(2,3)}$, $WCl_{(2,3,4)}$, and $VCl_{(2,3)}$) per any available art including any of the foregoing and forthcoming embodiments and then the resulting mixture is reduced to the base metal or base metal alloy per any of the foregoing and forthcoming embodiments.

In a preferred embodiment, the method comprises the step of continuously driving gaseous by-products away from the reaction zone by flowing gas in a direction away from the solid reactants and the end products. In one form, the gas can be inert gas (e.g. Ar or He). In other forms, the gas may include reactive components that can partly or fully react with the precursor materials or the solid reactants (e.g. $O_2$ and $N_2$).

In one embodiment, the powder product is based on carbides, silicides, borides, oxides, or nitrides of Zn, V, Cr, Co, Sn, Ag, Ta, Ni, Fe, Nb Cu, Pt, W, Pd, and Mo. The powder product is produced by processing metal chlorides with alloying additives including C, Si, B, $O_2$ or $N_2$ according to any of the foregoing and forthcoming embodiments.

In a preferred embodiment, aluminium chloride by-products condensed in parts of the reactor at lower temperature and collected separately.

In any of the embodiments, the method can be carried out at pressures between 0.0001 atm and 2 atm.

In all embodiments, the product is a powder composed of a base metal alloy or compound and can include any number of alloying additives based on any number of non-inert elements from the periodic table.

In all forms and embodiments of the method, the end-product of said method can include aluminium residues.

In all embodiments, the method can comprise the step of separating the end products from any residual unreacted precursor materials and unreacted aluminium. The method can also include the step of washing and drying the end products.

In one embodiment, the aluminium chloride by-products are reacted with base metal oxides at a temperature $T_{Cl\text{-}O}$ to produce base metal chlorides and aluminium oxide:

$$M_bO_x \text{ and } AlCl_3 \rightarrow M_bCl_y \text{ and } Al_2O_3 \quad (Ro1)$$

where $M_bO_x$ is the base metal oxide and $M_bCl_y$ is the base metal chloride. $M_bCl_y$ is then separated from the rest of the reaction products and recycled as a starting base metal chloride according to any of the embodiments and aspects described herein.

$T_{Cl\text{-}O}$ depends on the base metal oxide and can range from room temperature to more than 800° C. In one form of the embodiment, $T_{Cl\text{-}O}$ is below 200° C. In another form, $T_{Cl\text{-}O}$ is above 200° C. In another form, $T_{Cl\text{-}O}$ is above 500° C. In another form, $T_{Cl\text{-}O}$ is above 800° C.

In one embodiment, reaction Ro1 is carried out under inert atmosphere. In another embodiment, Ro1 is carried out in the presence of a Cl gas or HCl.

FIG. 4 is a block diagram illustrating main processing steps for the present invention.

In a first step, a control powder (1) is mixed and reacted with base metal chlorides (2) in (3). The resulting mixture is then reacted with Al (4) in step (5). Steps (3) and (5) together form the Reduction Stage (6). A part of the resulting product is recycled (7) through (1) and the remainder are moved for purification in (8). The products are discharged in (9). A part of the end-product may optionally be recycled (10) as control powder through (1). By-products (11) from the Purification Stage (8) can—optionally—be reacted with base metal oxides in (12) to produce base metal chlorides (13) which can then be recycled (14) through (2). The final by-product from step (12) would then be aluminium oxide (15).

FIG. 5 is a schematic diagram illustrating processing steps for one preferred embodiment for production of base metal alloys.

In a first step (1), an Al reducing agent is mixed with $AlCl_3$ to help dilute the Al and produce a more homogenous distribution during processing. Other alloying additives may be added and mixed with the Al—$AlCl_3$ if required. The control powder (2) and the base metal chlorides (3) are mixed, preferably continuously, in a premixer (4) under inert gas and under controlled conditions, together with other compatible alloying additives leading to Stream 1 (5). The Al reducing agent is mixed (6-7) with other precursors as appropriate (8) to form Stream 2 (9). The remaining alloying additive precursors (10) are prepared into one or more additional Stream 3 to n (11). Stream 1 (5), Stream 2 (9) and Stream 3-n (11) are reacted gradually in the Reduction Stage at temperatures between 160° C. and 600° C. (12). The Reduction Stage may include an internal recycling step (12A) wherein materials (12B) escaping the Reduction Stage reaction zone (12A) are condensed and recycled. Materials at the exit of the Reduction Stage may be recycled (12C) through (2) to be used as control powder. By-products (13) resulting from the Reduction Stage, including aluminium chlorides, may optionally be removed away from the reaction zone. However, in a preferred embodiment, by-products are recycled through (12A) or (12C). The Reduction Stage may be operated in a batch mode or in a continuous mode.

At the end of the Reduction Stage processing, materials are then processed through the Purification Stage (14) at temperatures between 200° C. and 1000° C. to complete the reaction and evaporate/remove residual un-reacted chemicals (15). The un-reacted chemicals (15) may be recycled (16) through the Reduction Stage or through the Purification Stage. By-products from the Purification Stage (13) are continuously removed away from the solid reactants. At the end of the high temperature processing cycle, the products are discharged (17) for post processing or storage (18). A part of products (17) may be recycled through (17A) to be used as control powder (2). All processing steps including mixing, and preparation of the precursor materials are preferably carried out under an inert atmosphere and any residual gas at the exit of the processing cycle is processed through a scrubber (19) to remove any residual waste (20). In one embodiment, remaining aluminium chloride by-products (21) are reacted with base metal oxides (22) to produce reaction products including base metal chloride and aluminium oxide. The resulting products are then processed in (23) to separate the base metal chlorides (24) from other by-products of the chlorination reaction (Ro1) (24). The resulting base metal chlorides (24) can then be withdrawn (25) or recycled through (3).

In one embodiment of the method in a continuous mode, wherein chlorides with a low boiling/sublimation temperature such as $TaCl_5$, $NbCl_5$, $MoCl_5$, $WCl_4$, $FeCl_3$, $VCl_4$ and $SnCl_4$ are used, materials evaporated from the Reduction Stage reactor are condensed separately or together with other reaction by-products such as aluminium chlorides outside the reactor in a dedicated vessel and then fed back into the reactor during the same processing cycle through one of the reactor inlets. The feeding rate of the condensates is regulated to avoid overloading of the reactor. In a second embodiment of the method, the collected condensates are recycled through the Reduction Stage, and this recycling process can be carried out multiple times or until all the starting base metal chlorides have been reduced. In this embodiment, the recycling can occur several times or continuously to minimise the concentration of the base metal chlorides in the collected aluminium chloride by-products. In one variation of this embodiment, the condensates are used as a control powder.

FIG. 6 shows a general block diagram illustrating one general embodiment of the method including processing volatile chloride precursors (e.g. $TaCl_5$).

Here, a condenser linked to the Reduction Stage can be used and the temperature in the Reduction Stage reactor is set at a temperature below 600° C. while the temperature of the condenser is set a temperature below 200° C. Materials evaporated from the reactor are condensed in the condenser zone either as pure molten $TaCl_5$ or as a mixture or a solution $TaCl_5$—$AlCl_3$ and then the condensed materials are driven back the reaction zone. This recycling process provides a cooling mechanism for materials in the reactor due to evaporation-condensation-recycling and provides a self-regulating mechanism for keeping the pressure in the reaction vessel close to 1 atmosphere.

In one embodiment, the alloy product is a superalloy based on nickel, cobalt or iron.

In one embodiment, the alloy product is a high entropy alloy (HEA), including at least four elements from the group including the base metals, Al and the alloying additives, with individual concentrations ranging from 5 wt % and 50 wt %. In one form of this embodiment, the constituent elements are equimolar. The HEA powder must include at least two base metals.

In one embodiment, the method includes the additional step of post-processing the powder to make its grains substantially spherical, for example by plasma processing, to make the grains suitable for use in 3D printing.

In one embodiment, the alloy product is a magnetic powder based on Fe, Ni and/or Co. In one form of this embodiment the product is an Alnico powder based on Fe—Al—Ni—Co and produced according to any of the foregoing or following embodiments of the method and then there are the additional steps of consolidating the resulting alloy powder, shaping the resulting consolidated article, and then magnetising the shaped article to produce a magnet. The powder produced according to this embodiment can include alloying additives and Al.

In one embodiment of the method for production of catalysts, a base metal powder is produced according to any of the embodiments of the method, the powder is based on Al, Zn, V, Cr, Co, Sn, Ag, Ta, Ni, Fe, Nb Cu, Pt, W, Pd, and Mo, and optionally including alloying additives, and then there can be the additional optional step of further processing the resulting base metal alloy powder to produce a catalyst. In one form of this embodiment, the powder product has an Al content of more than 10 wt %, and there is the additional step of dissolving the Al by an operable means to produce a skeletal catalyst. Operable means include washing the powder product with alkaline solutions (e.g NaOH) or acidic solutions ($H_2SO_4$, HF . . . ).

In one variation of the last embodiment, a powder with a composition of $M_{bx}Al_yC_z$ is produced in accordance with any of the foregoing or following embodiments and then the Al is removed by washing the powder product with alkaline solutions (e.g NaOH) or acidic solutions ($H_2SO_4$, HF . . . ) to obtain a composition $M_{bx}C_z$ with tailored pore structure and tailored morphology; x, y and z represent the molar number for $M_b$, Al and C. The resulting material structure can be a layered structure or porous structure or nanostructured structure with an $M_{bx}C_z$ based composition.

In one embodiment, the method includes the optional additional step of exposing the powder product to a reactive substance to form a coating on the powder particles.

Generally, the product of the method is in the form of a powder with a spongy structure and with a grain size between 5 nm and 500 microns.

In one preferred embodiment per the fourth aspect, there is provided a method for production of a multi-component powder or a composite powder, wherein the control powder has a substantially different composition from the elemental composition produced through reduction of the starting base metal chlorides with Al and wherein the final product contains a substantial amount of unreacted control powder; the control powder can be one or a mixture of flakes, fine or coarse particulate and fibrous materials. In one form of this embodiment, the control powder consists of a pure metal or an alloy with a composition different to the elemental composition produced by reducing the starting base metal chloride with Al. Carrying out the process per any of the previous embodiments causes the control powder to be covered or surrounded by alloys or compounds resulting from the reduction of the starting chemicals with Al. The control powder can be made of particles in the form of one or a mixture of spherical particulates, irregular shape particulates, flakes, or fibres.

Referring to the diagrams in FIGS. 5 and 6, the reducible materials $MbCl_x$, the control powder $M_c$, and the solid Al reducing agent are fed into the reactor, and mixed in-situ and heated at temperatures between 160° C. and 700° C. As the amount of Me exceeds $MbCl_x$ and the amount of Al, $MbCl_x$ tends to react first with $M_c$ and then the resulting intermediates react with the Al scavenger. As the materials react, they form an intermediate product of the base metal alloy and residual un-reacted materials. In one embodiment in batch mode operation, this intermediate product can act as the control powder when further reactants are transferred into the reactor. In a continuous mode operation, the intermediate products can be continuously or semi-continuously recycled through the Reduction Stage as a control powder. There may need to be some initial charge of control powder used at the beginning of the operation.

In all embodiments, inert gas may be used to help direct gaseous chloride species through the various processing zones or outside for collection and further processing and/or recycling. In all embodiments, unreacted base metal chlorides may be condensed and returned for processing at higher temperatures in the reactor either continuously or in a batch mode.

The residence time of the reactants through the Reduction Stage at temperatures below $T_1$ is determined by a combination of factors including the threshold reaction temperature and the physical characteristics of the base metal chlorides being processed; preferably and where possible, $T_1$ is set at a value below the boiling/sublimation temperature of the starting base metal chlorides.

As materials from the Reduction Stage progress through the Purification Stage reactor, remaining un-reacted materials react, leading to formation of Al chloride by-products. An external gas flow can be used to help drive volatiles from the reactants in a direction opposite to the movement of the solid reactants. The external gas flow drives the $AlCl_3$ by products away from the solid products and out of the reactor where they are stripped out of the gas stream in a dedicated collector at a temperature lower than 160° C. Reactants in the Purification Stage reactor are preferably continuously mixed to help maximise reaction yield and minimise losses of base metal chlorides. Un-reacted materials reaching the high temperature section within the Purification Stage reactor are evaporated and driven by the external gas flow towards lower temperature regions where they are condensed and then recycled.

The residence time of the materials through the Purification Stage of the reactor affects the degree of agglomeration/sintering of the powder products and the method can include the step of varying the residence time to obtain a desired particle size distribution/morphology.

As discussed before, the processing temperatures in both the Reduction Stage and in the Purification Stage, are determined by the materials properties of the base metals and the base metal chlorides, in addition to the composition and morphology of the end-product. The value of the minimum temperature can also depend on the sublimation temperature of precursor materials and the method can include a primary reduction step as described in following embodiments. However, it is preferable that the minimum temperature in the Purification Stage reactor be around 200° C. so that it is higher than the sublimation temperature of aluminium chloride.

Another objective of the present invention is to provide a reactor for carrying out the method as described in the various embodiments. The reactor consists of vessels for carrying out the Reduction Stage and the Purification Stage reactions and may be made of any materials capable of withstanding temperatures up to 1100° C. without reacting with the precursor chemicals and end-products. The reactor might consist of any containment vessel and associated accessories capable of providing intimate and efficient contact between the reducible materials stream and the reducing Al alloy stream. The reactor can consist of two separate vessels for the Reduction Stage and the Purification Stage or of a single vessel arranged in use to handle both the Reduction Stage and the Purification Stage reactions. Both the Reduction Stage reactor and the Purification Stage reactor can include mechanisms for moving and mixing the reactants. In a preferred embodiment, the Purification Stage reactor consists of a tubular reactor capable of operating at temperatures up to 1100° C., with means for moving, mixing, heating, recycling and transferring the reactants, a by-product collection unit and an end-product collection unit.

In a preferred embodiment, the reaction vessel may comprise several discrete heating zones, each zone providing for a different reaction or condensation function.

In all embodiments, the reactor can further comprise further gas inlets located throughout the reaction vessel and its accessories.

In all embodiments, the reactor comprises exhausts for removing gases from the reactor.

In one embodiment, the reactor can comprise moving apparatus for moving and mixing the powder from the reactor inlet to the reactor outlet.

FIG. 7 is a schematic diagram showing an example for a reactor configuration including both the Reduction Stage and the Purification Stage for carrying out the process in a continuous mode.

For this basic configuration, there is provided a mixer/reactor system intended for illustrating key functions of a reactor suitable for implementing some preferred continuous embodiments. The Reduction Stage reactor main body (301) is a cylindrical vessel made of materials capable of handling chemicals based on the base metals and the alloying additives at temperatures up to 1100° C. The reactor vessel (301) includes means for heating and cooling the vessel at the required operating temperatures. A continuous premixer (302) is provided with a mixer (303) driven externally by (304) for mixing base metal chlorides (305), the control powder (306) and the reducing Al alloy powder (307), and then the resulting mixture is fed through inlet (309) to the reactor (301). Also, provided but not shown in the diagram are hoppers and feeders for holding and transporting the reactants into the premixer. The premixer is not critical to the operation of the reactor and feeding inlets may or may not be directly attached to the reactor body. Gas inlet (310 and 310A) are also provided at the inlet of the reactor and a flow is imposed through (301) in the same direction as the solid reactants. Alloying additives may be introduced either directly to the premixer (302) or as a component of the other reactants (305) and (307).

At the exit of reactor vessel (301), there is provided a condenser (311) wherein materials from (301) including gaseous species escaping/evaporated from the reactor vessel (301) can be made to condense/cooled down prior to transferring into a holding vessel (312). The condenser is held at room temperature and includes means for transporting the reactants from inlet to exit. Means for condensing gaseous species in the condenser can include any prior known arts including fluidised bed, cooled scrappers and/or any other means that can condense gaseous chloride species and mix with other solid product to produce mixture (314) prior to transfer into (313). The temperature of the condenser is regulated using external cooling means (not shown). Inert gas from (301) can exit through port (315). A part of mixture (314) is driven using an appropriate conveyor system (316) back to the premixer and used as a control powder. The remaining part is transferred into the Purification Stage reactor (317).

In one embodiment not shown here, the reactor vessel (301) includes an additional exhaust at the level of the powder exit and this additional exhaust can be used to remove gaseous aluminium chloride prior to the reactant fed into condenser (311).

For the Purification Stage, there is provided a basic conveyor screw configuration intended only for illustrating key functions of a reactor suitable for implementing some preferred embodiments as per foregoing aspects of the invention described herein. The purification reactor main body consists of a tubular main section (317) made of materials capable of operating at temperature up to 1100° C. and not react with the materials processed therein. For the example in FIG. 7, there is provided an auger (318) for moving the reactants through (317). Section (317) has an outlet (319) for gases used in the reactor and any gaseous by-products resulting from the process to exit the reactor. The reactor also includes a vessel or vessels (320) for collecting by-products out of the gas stream. Section (317) also includes means (321) for moving the powder from (312) into the reactor.

On the product outlet end, there is provided one or multiple openings (322) to introduce inert gas and gaseous precursor materials. Also provided is a product outlet opening (323) and a product collection vessel (324).

Preferably, Section (317) and all internal walls located within this section are kept a temperature higher than the boiling temperature(s) or the sublimation temperature(s) of the by-products. Section (317) has a minimum temperature $T_2$ at the entry of the powder through (321) increasing to a temperature $T_{max}$ at the level of (325) and then decreasing to room temperature at the level of powder product outlet. Temperatures $T_2$ and $T_{max}$ depend on the materials being processed therein. $T_2$ and $T_{max}$ are regulated using heating/cooling means (not shown). $T_2$ is preferably higher than the sublimation temperature(s) of the by-products. Preferably, minimum temperature in $T_2$ is around 200° C.

As discussed before, $T_{max}$ is preferably below 1100° C. and more preferably below 1000° C. and still more preferably below 900° C. Past the reactor section at $T_{max}$, the products are progressed towards the powder exit where they are cooled to room temperature and discharged. By way of example, for conditions where nickel chlorides are being reduced with Al, maximum temperature for the Reduction Stage (301), $T_1$, is set at 500° C., minimum temperature in the Purification Stage, $T_2$, is preferably set to 200° C. and $T_{max}$ is set to a temperature between 850° C. and 950° C.

The configuration in FIG. 7 is only intended to illustrate functionality of a continuous reactor, and some accessories forming part of the reactor system are not shown, including storage containers for holding solid reactants under inert atmosphere, powder feeding accessories and powder mixers.

For the reactor configuration in FIG. 7, reducible precursor materials in (305), (306) and (307) are fed separately into the continuous premixer (302) and then into reactor (301) and mixed in-situ and heated at temperatures between 160° C. and 660° C. As the materials react, they form an intermediate product of the base metal alloy and residual unreacted materials, and this product is then processed though the condenser (311). A part of the resulting mixture is recycled back to the premixer as a control powder. Note that there may need to be some initial charge of control powder used at the beginning of the operation.

As products from the Reduction Stage progress though reactor section (317), remaining unreacted materials are reacted or evaporated. An external gas flow is driven into the reactor through the gas opening (322) in a direction opposite to the movement of the solid reactants. The external gas flow helps drive by-products out of the Purification Stage reactor. Reacting materials in section (317) are continuously mixed to maximise contact surface area between the reactants and enhance reduction reactions residual unreacted reactants. Product formation proceeds through formation of small particulates of sub-micron dimension first followed by sintering and agglomeration of the particulates leading to products with large particle size. The residence time of the materials through the reactor affects this agglomeration/sintering process and the method includes the step of setting the residence time to obtain a desired particle size distribution and degree of agglomeration.

In a preferred embodiment, the heating/cooling means in sections (301), (311) and (317) manage heat flow within the reactor and maintain the temperature profile required for processing through both stages but particularly through the Reduction Stage. As can be seen in Table 1, for all base metals subject to this disclosure, the reactions between the precursor base metal chlorides and the reducing Al alloy are highly exothermic. Nevertheless, some parts of the reactor body may need to be heated initially to reach a threshold temperature adequate for initiating the reaction, but then the reactor may need to be cooled to maintain the threshold temperature and prevents overheating.

EXAMPLES

The following examples illustrate preparation of base metal alloys and compounds in accordance with embodiments of the present invention.

Ms: Mass of starting chemicals (mg)

Me: Mass of base metal element in end-product (mg)

Example 1: Fe—Al—Cr Alloy

| Element | Starting Chemical | Ms (mg) | wt % |
|---|---|---|---|
| Cr | $CrCl_3$ | 473 | 16.80 |
| Fe | $FeCl_3$ | 2362 | 81.24 |
| Al | $AlCl_3$ | 490 | 1.96 |

Control powder: Fe—Al—Cr alloy.

Total end products: ~825 mg

The following method has been used for the tests in the examples listed below. Ecka Al powder with a grain size 4 microns is used for all tests except where stated otherwise.

a) Precursor base metal chlorides are first thoroughly mixed together to produce a homogeneous base metal chloride mixture (Mx1).

b) Al is mixed with $AlCl_3$ to produce an Al—$AlCl_3$ mixture with a mass equal to that of the base metal chloride mixture (Mx2). This last step is intended to: (i) improve contact between the base metal chlorides and the reducing Al when mixed together during reduction; and (ii) use the $AlCl_3$ as a cooling agent in the Reduction Stage.

c) 100 mg of Mx1 is mixed with an amount of Mx2 (100 Mx2/Mx1) and the resulting mixture is introduced into a quartz tube under Ar at 1 atm.

d) The mixture is heated at 500° C. while the quartz tube is being rotated to provide adequate mixing for the reactants. For the first step without the control powder, the reaction occurs in an explosive manner causing the powder to be thrown out of the bottom of the tube. The powder is then collected and heated again to complete the reaction between Mx1 and the reducing Al; intermediate products from this step are referred to as Pd1.
e) Remove by-products.
f) Pd1 is mixed with an amount of Mx1 and Mx2, (Pd1>Mx1+Mx2). Mx1 and Mx2 are increased after every cycle as the experiment progresses and more products are produced.
g) Go to d).
h) Continue until all the precursor materials are used.
i) The mixture is then heated at temperatures from 500° C. up to 1000° C. in steps of 100° C. for 10 minutes at each step.
j) The powder is then discharged, washed, dried and analysed.

Example 2: Ni Powder

| Element | Starting Chemical | Ms (mg) | Me (mg) | wt % |
|---|---|---|---|---|
| Ni | $NiCl_2$ | 4920 | 2080 | 100 |
| Al | Al | 720 | 0 | 0 |

Control powder: Ni. The Al powder is mixed with 1.740 g of $AlCl_3$.

Total end products: ~2 g

The reduction process is carried out as described before for Example 1. The resulting powder consisted of agglomerated irregular spongy grains with a wide size distribution. The powder was analysed using XRD, XRF and ICP. The XRD trace is in FIG. 8, showing peaks consistent with pure Ni. ICP analysis suggested the Al content was less than 0.1 wt %.

Example 3: Fe Powder

| Element | Starting Chemical | Ms (mg) | Me (mg) | wt % |
|---|---|---|---|---|
| Fe | $FeCl_3$ | 5814 | 2000 | 100 |
| Al | Al | 966 | 0 | 0 |

Control powder: Fe. The Al powder is mixed with 1.940 g of $AlCl_3$.

Total end products: ~1.8 g

The reduction process is carried out as described before for example 1.

The powder was analysed using XRD, XRF and ICP. The XRD trace is in FIG. 9, showing peaks consistent with pure Fe. ICP analysis suggested the Al content was less than 0.1 wt %.

Example 4: SS316

| Element | Starting Chemical | Ms (mg) | Me (mg) | wt % |
|---|---|---|---|---|
| Fe | $FeCl_3$ | 19767 | 6800 | 68 |
| Ni | $NiCl_2$ | 2838 | 1200 | 12 |

-continued

| Element | Starting Chemical | Ms (mg) | Me (mg) | wt % |
|---|---|---|---|---|
| Cr | $CrCl_3$ | 4784 | 1700 | 17 |
| Mo | $MoCl_5$ | 855 | 300 | 3 |
| Al | Al | 4625 | 0 | 0 |

Control powder: Semi processed intermediate products from Reduction Stage. The Al powder is mixed with 9.25 g of $AlCl_3$.

Products: ~9.6 g

The reduction process is carried out as described before for example 1. The powder consists of irregular agglomerated particles. The XRD trace is in FIG. 10. ICP and XRF analysis suggest Al is of the order of 0.7 wt % while Cr is around 12.7 wt % and is lower than target (17 wt %). This discrepancy is likely to have resulted from the batch nature of the test tube processing with inefficient mixing and lack of recycling. Because $CrCl_x$ is more stable than other chloride reactants, elemental Cr tends to reduce $FeCl_x$, $NiCl_2$ and $MoCl_x$. As $CrCl_2$ is quite stable it can only be reduced tough direct contact with Al. Two remedies have been developed for this problem; the first is to increase reduction/recycling time and improve mixing. The second is to compensate for limited reactivity of $CrCl_x$ by using a higher amount of $CrCl_3$ in the starting precursors.

Example 5: Inconel 718

| Element | Starting Chemical | Ms (mg) | Me (mg) | wt % |
|---|---|---|---|---|
| Ni | $NiCl_2$ | 6300 | 2660 | 53.26 |
| Fe | $FeCl_3$ | 2689 | 925 | 18.5 |
| Cr | $CrCl_3$ | 2617 | 930 | 18.6 |
| Mo | $MoCl_5$ | 442 | 155 | 3.1 |
| Nb | $NbCl_5$ | 728 | 250 | 5 |
| Ti | $TiCl_3$ | 145 | 45 | 0.9 |
| Mn | $MnCl_2$ | 23 | 10 | 0.2 |
| C | C | 2 | 2 | 0.04 |
| Al | Al | 2039 | 20 | 0.4 |

Control powder: semi-processed INCONEL-$AlCl_3$ powder from the Reduction Stage. The Ecka Al powder is mixed with 4.434 g of $AlCl_3$.

Products: ~4.85 g

The reduction process is carried out as described before for example 1. The XRD trace is in FIG. 11, showing peaks consistent with Inconel 718. ICP and XRF analysis suggest Al content is 0.4 wt %, Ti 0.2 wt %, Mn 0.1 wt %, Mo 3.4 wt %, Nb 5.6 wt %, Cr 13.6 wt %, Fe 19.4 wt %, Ni balance.

Example 6: MAR-M-509

| Element | Starting Chemical | Ms (mg) | Me (mg) | wt % |
|---|---|---|---|---|
| Co | $CoCl_2$ | 6054 | 2745 | 54.9 |
| Ni | $NiCl_2$ | 1183 | 500 | 10 |
| Cr | $CrCl_3$ | 3293 | 1170 | 23.4 |
| Ta | $TaCl_5$ | 347 | 175 | 3.5 |
| W | $WCl_6$ | 620 | 350 | 7 |
| Ti | $TiCl_3$ | 40 | 12.5 | 0.25 |
| Zr | $ZrCl_3$ | 45 | 17.5 | 0.35 |
| C | C-$AlCl_3$ | 300 | 30 | 0.6 |
| Al | Al | 1676 | 0 | 0 |

Control powder: semi processed MAR-M-509-$AlCl_3$ from the Reduction Stage. C is introduced in the form of milled graphite, 1 part graphite-9 parts $AlCl_3$. Al is introduced as Al—$AlCl_3$ 1 part Al-3 parts $AlCl_3$. The Al powder is mixed with 4.265 g of $AlCl_3$.

Products: ~4.8 g

The reduction process is carried out as described before for example 1. The XRD trace is in FIG. 12 consistent with known patterns of the alloy. ICP Analysis suggest Al content is below 500 ppm.

Example 7: Production of Ta from $TaCl_5$

| Element | Starting Chemical | Ms (mg) | Me (mg) | wt % |
|---|---|---|---|---|
| Ta | TaCl5 | 10400 | 5000 | 100 |
| Al | Al | 1243 | 0 | 0 |

$TaCl_5$+1.666 Al=Ta+1.666 $AlCl_3$

Ecka Al (grain size=4 microns) is mixed with $AlCl_3$ (wt ratio 1:2); total: 3.730 g.

The amount of $TaCl_5$ is 5% above stoichiometric level to account for losses associated with the manual processing of the materials. Excess tantalum chlorides are removed during the Purification Stage.

Control powder: Ta.

Total end products: ~4.77 g

The reduction process proceeds as follows:

Furnace is set at 500° C.

Step 1: 100 mg of $TaCl_5$+33 mg Al—$AlCl_3$ introduced into a quartz tube.

Step 2: Insert quartz tube into furnace; as the reaction occurs and aluminium chloride by-products+some $TaCl_5$ evaporate and get deposited onto cold section of the tube.

Remove tube from furnace.

Scrape by-products+residuals back into reaction zone at the bottom of the tube.

The resulting mixture will be used as control powder for next reaction cycle.

Step 3: Add 50 mg more than step $TaCl_5$ and third the weight of $TaCl_5$ of Al—$AlCl_3$.

Mix with control powder already in tube.

GO to Step 2.

Continue process until all $TaCl_5$ is used.

Add remaining Al—$AlCl_3$ and go to Step 2.

Mix products with collected by-products+residuals.

Heat at 500° C. for 10 minutes.

Collect by-products+residuals.

Mix products with collected by-products+residuals

Heat at 500° C. for 10 minutes. Collect and remove resulting by-products.

Heat in rotating quartz tube at temperature from 500° C. up to 1000° C. in steps of 100° C., for 10 min in each step.

Collect product. Wash and dry.

Analysis: XRD analysis for the resulting materials is shown in FIG. 13 and is consistent with pure Ta. ICP analysis shows the Al concentration in the sample to be around 530 ppm.

Example 8: SMA-FeNiCoAlTaB Powder

| Element | St Ch | Ms (mg) | Me (mg) | wt % |
|---|---|---|---|---|
| Fe | $FeCl_3$ | 1329 | 457 | 41.5 |
| Co | $CoCl_2$ | 442 | 200 | 18.2 |

-continued

| Element | St Ch | Ms (mg) | Me (mg) | wt % |
|---|---|---|---|---|
| Ni | $NiCl_2$ | 689 | 291 | 26.5 |
| Ta | $TaCl_5$ | 179 | 90.5 | 8.2 |
| B | B | 0.11 | 0.11 | 0.01 |
| Al | Al | 445 | 62.1 | 5.6 |

Starting precursor for boron is B powder. Ecka Al (4 microns) is mixed with 1.555 g of $AlCl_3$.

The process is carried out as described in Example 1. ~0.92 g of powder collected. An XRD spectra is shown in FIG. 14. ICP and XRF analysis show the composition conforms with target.

Example 9: AlCoCrCuFeNi HEA Powder

| Element | St Ch | Ms (mg) | Me (mg) | wt % |
|---|---|---|---|---|
| Co | $CoCl_2$ | 1300 | 589 | 18.64 |
| Ni | $NiCl_2$ | 1230 | 520 | 16.46 |
| Cr | $CrCl_3$ | 1652 | 587 | 18.58 |
| Cu | $CuCl_2$ | 1346 | 636 | 2011 |
| Fe | $FeCl_2$ | 1625 | 559 | 17.67 |
| Al | Al | 1350 | 270 | 8.54 |

Control powder: AlCoCrCuFeNi HEA powder. Ecka Al (grain size=4 microns) is mixed with $AlCl_3$ (wt ratio 1:2); total: 4.050 g.

Total end products: ~3 g.

The reduction process is carried out in two steps:

First, procedures described for Example 1 are used throughout the Reduction Stage to obtain an approximate composition equivalent to CoCrCuFeNi.

Then, the remaining Al is added gradually using same procedure used Example 1.

The resulting materials are then processed through the Purification Stage to remove residual chlorides and coarsen the powder products.

XRD patterns for the resulting powder products is shown in FIG. 15.

The products were analysed using XRF and ICP and the results conforms to the expected composition.

Example 10: Skeletal Co Catalyst

| Element | Starting Chemical | Ms (mg) | Me (mg) | wt % |
|---|---|---|---|---|
| Co | $CoCl_2$ | 1299 | 589 | 81 |
| Al | Al | 990 | 0 | 19 |

The base metal chlorides are mixed with 2.7 g of $AlCl_3$

Ecka Al (4 microns) is mixed with $AlCl_3$ (wt ratio 1:2); total: 2970 mg.

The reduction process is carried out in two steps:

First, procedures used for Example 1 for MAR-M-509 are used throughout the Reduction Stage to obtain an approximate composition equivalent to Co.

Then, the remaining Al is added gradually using same procedure used Example 1.

The resulting materials are then processed through the Purification Stage to remove residual chlorides and coarsen the powder products.

XRD patterns for the resulting powder products is shown in FIG. 16.

A 1 g sample of the Co—Al powder is washed (for 2 hours) in 60 ml of $H_2O$ plus 10 ml of NaOH (50% mol). The powder is then rinsed in distilled water until PH is neutral. An XRD trace of the resulting materials is in FIG. 17. Noted is the absence of significant peaks, due to the super fine structure of the resulting skeletal structure.

The present method may be used for production of alloys and compounds of various compositions including compounds of pure metal, oxides and nitrides of Al, Zn, V, Cr, Co, Sn, Ag, Ta, Ni, Fe, Nb Cu, Pt, W, Pd, and Mo and including alloying additives as described before. Modifications, variations, products and use of said products as would be apparent to a skilled addressee are deemed to be within the scope of the present invention.

Materials produced using the present invention have unique characteristics that may not be obtained using prior arts. Our claims extend to materials that can be made using the present invention and use of the materials, without limitations by the examples provided in these specifications by way of illustration. Specific properties include the ability to produce nano-structured and/or complex compositions that can be unachievable with conventional powder production techniques.

In the claims, which follow and in the preceding description of embodiments, except where the context requires otherwise due to express language or necessary implication, the words "comprise" (and "include") and variations such as "comprises" or "comprising" (and "includes" or "including") are used in an inclusive sense, to specify the presence of the stated features but not to preclude the presence or addition of further features in various embodiments of the invention.

Also, it will be understood to persons skilled in the art of the invention that many modifications may be made without departing from the spirit and scope of the invention; in particular, it will be apparent that certain features of embodiments of the invention can be employed to form further embodiments.

The invention claimed is:

1. A method for controlled exothermic reduction of a metal chloride of one or more of Zn, V, Cr, Co, Sn, Ag, Ta, Ni, Fe, Nb, Cu, Pt, W, Pd, Mo, Pb, Sb, Bi, In, Cd, Ga, Rh, Ir, Ru, Os, and Re, with an Al reducing agent, the method comprising:

contacting said one or more metal chlorides, a control powder and an Al reducing agent, all in a fine particulate form, at a reaction temperature between 25° C. and a maximum temperature $T_{max}$ to form a metal or metal alloy product in a powder form and a by-product including aluminium chloride; and separating the by-products from the metal or metal alloy powder product;

wherein the control powder includes one or more of Zn, V, Cr, Co, Sn, Ag, Ta, Ni, Fe, Nb, Cu, Pt, W, Pd, and Mo, or an alloy or compound thereof, and acts to control exothermic heat release from the reduction and to thereby keep reaction temperatures to less than $T_{max}$;

wherein $T_{max}$ is between 400° C. and 1100° C., and below the melting temperature of the metal or metal alloy product; and wherein the reaction is controlled such that heat generated by the reduction does not increase the reaction temperature by more than 600° C. from a temperature of said contacting.

2. The method according to claim 1, wherein $T_{max}$ is higher than the sublimation/evaporation temperatures of all of the one or more metal chlorides.

3. The method according to claim 1, wherein in a first step said metal chlorides are metal chlorides which are mixed and reacted with the said control powder and then resultant intermediate products are reacted with an Al reducing agent powder.

4. The method as claimed in claim 1, wherein the control powder is included in an amount sufficient to absorb heat generated by the exothermic reactions and limit increases in reaction temperature to less than ΔT=600° C., and where the amount of control powder per 1 kg of metal chlorides is between $M_c/100$ and $M_c$; and $$M_c = \mathrm{Max}\left[0, \frac{\Delta G - \int_{T_{min}}^{T_r+\Delta T} (M_b C_{p-b} + M_{AlCl3} C_{p-AlCl3}) dT}{\int_{T_r}^{T_r+\Delta T} C_{p-b} dT}\right]$$

wherein $T_{min}=T_r$, and wherein the ratio of the one or more metal chlorides to control powder is between 0.03 to 1 and 100 to 1.

5. The method as claimed in claim 1, wherein the control powder further includes an aluminium chloride.

6. The method as claimed in claim 1, wherein the metal chloride is selected from a chloride of one or more of Zn, V, Cr, Co, Sn, Ag, Ta, Ni, Fe, Nb, Cu, Pt, W, Pd, and Mo.

7. The method according to claim 1, further comprising:

preparing a first stream of materials including the one or more metal chlorides;

preparing a second stream of materials including the Al reducing agent; and preparing a third stream of materials including the control powder;

feeding said streams into a reaction zone and mixing and reacting the said streams at temperatures between 25° C. and $T_{max}$;

wherein:

$T_{max}$ is below 1100° C.;

the Al reducing agent comprises a pure element, an alloy or a compound based on Al; and the metal chloride is a chloride of one or more of Zn, V, Cr, Co, Sn, Ag, Ta, Ni, Fe, Nb, Cu, Pt, W, Pd, and Mo.

8. The method as claimed in claim 7, further comprising:

continuously feeding and mixing materials from said streams at temperatures increasing from a temperature $T_0$ to a temperature $T_1$ for a first residence time and then at temperatures between $T_2$ and $T_{max}$ for a second residence time; wherein $T_0$ is between 160° C. and 600° C., $T_1$ is below 660° C., $T_2$ is between 200° C. and 700° C., and $T_{max}$ is below 1100° C.; and wherein the first residence time is sufficient to reduce substantially all the starting base metal chlorides to a chlorine content less than 50% of the chlorine in the starting base metal chloride.

9. The method as claimed in claim 1, wherein the metal chloride comprises one or more of $ZnCl_2$, $VCl_{(2,3,4)}$, $CrCl_{(2,3)}$, $CoCl_2$, $SnCl_{(2,4)}$, AgCl, $TaCl_{(4,5)}$, $NiCl_2$, $FeCl_{(2,3)}$, $NbCl_5$, $CuCl_{(1,2)}$, $PtCl_{(4,3,2)}$, $WCl_{(4,5,6)}$, $PdCl_2$ and $MoCl_5$, and wherein reactions between the metal chlorides and the Al reducing agent are exothermic at temperatures below 500° C. and with energy release exceeding 10 kJ per mole of the said metal chloride.

10. The method as claimed in 9, wherein gaseous by-products produced by the exothermic reactions induce additional mixing of the one or more metal chlorides, Al reducing agent and control powder.

11. The method as claimed in claim 1, wherein the control powder is a pre-processed partially reduced or fully reduced product from the contacting step or the separating step, and wherein base metal species in the control powder has a Cl content less than 50% of the one or more metal chlorides.

12. The method as claimed in claim 1, wherein the metal chloride reacts with the control powder by chlorine exchange reactions and/or single replacement reactions to produce an intermediate reducible species.

13. The method according to claim 1, for producing one of an alloy, compound or catalyst, comprising performing the method of claim 1 to produce a metal alloy product containing one or more of Zn, V, Cr, Co, Sn, Ag, Ta, Ni, Fe, Nb, Cu, Pt, W, Pd, and Mo, and containing more than 10 wt % Al; and a further second step of removing the Al by dissolving in an alkali metal hydroxide or in an acid.

14. The method as claimed in claim 1, wherein the metal chloride includes Ta $Cl_s$ $NbCl_5$, $MoCl_5$, $FeCl_3$, $WCl_{(4,\ 5\ or\ 6)}$, $VCl_{(3\ or\ 4)}$ or $SnCl_4$ and the method comprises a primary step of reducing the metal chloride to produce an intermediate product, including $TaCl_{(0,\ 2,\ 3\ or\ 4)}$, $NbCl_{(0,\ 2,\ 3\ or\ 4)}$, $MOCl_{(0,\ 2,\ 3\ or\ 4)}$, $FeCl_{(0\ or\ 2)}$, $WCl_{(0,\ 2,\ 3,\ 4\ or\ 5)}$, $VCl_{(0,\ 2\ or\ 3)}$ or $SnCl_2$.

15. The method as claimed in claim 1, wherein the metal chloride includes Ta $Cl_s$ $NbCl_5$, $MoCl_5$, $FeCl_3$, $WCl_{(4,\ 5\ or\ 6)}$, $VCl_{(3\ or\ 4)}$ or $SnCl_4$ and the method includes the steps of:

reacting the metal chloride with a control powder and the Al reducing agent in a reaction zone at temperatures below 600° C. to produce a mixture of metal or metal alloy, Al or Al alloy and metal subchlorides; and condensing metal chlorides evaporated from the reaction zone and return them to the said reaction zone; the condensed metal chlorides being in a solid powder or a liquid form; and processing the resulting mixture of metal or metal alloy, Al or Al alloy and metal subchlorides to produce a base metal alloy.

16. The method according to claim 1, further comprising:

preparing a first stream of materials including the one or more metal chlorides and alloying additive precursors;

preparing a second stream of materials including the Al reducing agent; and preparing a third stream of materials including the control powder;

feeding said streams into a reaction zone and mixing and reacting the said streams at temperatures between 25° C. and $T_{max}$;

wherein:

$T_{max}$ is below 1100° C.;

the Al reducing agent comprises a pure element, an alloy or a compound based on Al;

the metal chloride is a chloride of one or more of Zn, V, Cr, Co, Sn, Ag, Ta, Ni, Fe, Nb, Cu, Pt, W, Pd, and Mo, and the precursor materials for the alloying additive precursors include one or more of pure elements, chlorides, oxides, or nitrides of an alloying element.

17. The method according to claim 1, further comprising:

preparing a first stream of materials including the one or more metal chlorides and alloying additive precursors;

preparing a second stream of materials including the Al reducing agent; and preparing a third stream of materials including the control powder;

feeding said streams into a reaction zone and mixing and reacting the said streams at temperatures between 25° C. and $T_{max}$;

wherein:

$T_{max}$ is below 1000° C.;

the Al reducing agent comprises a pure element, an alloy or a compound based on Al;

the metal chloride is a chloride of one or more of Zn, V, Cr, Co, Sn, Ag, Ta, Ni, Fe, Nb, Cu, Pt, W, Pd, and Mo, and the precursor materials for the alloying additive precursors include one or more of pure elements, chlorides, oxides, or nitrides of an alloying element.

18. The method according to claim 1, further comprising:

preparing a first stream of materials including the one or more metal chlorides;

preparing a second stream of materials including the Al reducing agent; and preparing a third stream of materials including the control powder;

feeding said streams into a reaction zone and mixing and reacting the said streams at temperatures between 25° C. and $T_{max}$;

wherein:

$T_{max}$ is below 1000° C.;

the Al reducing agent comprises a pure element, an alloy or a compound based on Al; and the metal chloride is a chloride of one or more of Zn, V, Cr, Co, Sn, Ag, Ta, Ni, Fe, Nb, Cu, Pt, W, Pd, and Mo.

19. The method as claimed in claim 1, wherein the control powder is a pre-processed partially reduced or fully reduced product from the contacting step or the separating step, and wherein base metal species in the control powder has a Cl content less than 80% of the one or more metal chlorides.

* * * * *